US009711133B2

(12) United States Patent
Yamamoto

(10) Patent No.: US 9,711,133 B2
(45) Date of Patent: Jul. 18, 2017

(54) ESTIMATION OF TARGET CHARACTER TRAIN

(71) Applicant: Yamaha Corporation, Hamamatsu-shi, Shizuoka-ken (JP)

(72) Inventor: Kazuhiko Yamamoto, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/813,007

(22) Filed: Jul. 29, 2015

(65) Prior Publication Data

US 2016/0034446 A1 Feb. 4, 2016

(30) Foreign Application Priority Data

Jul. 29, 2014 (JP) ..... 2014-153596

(51) Int. Cl.
*G10L 13/027* (2013.01)
*G10H 7/00* (2006.01)
(Continued)

(52) U.S. Cl.
CPC ..... *G10L 13/027* (2013.01); *G10H 7/008* (2013.01); *G10H 7/02* (2013.01);
(Continued)

(58) Field of Classification Search
CPC ..... G10L 15/00; G10L 15/005; G10L 15/02; G10L 15/06; G10L 15/08; G10L 15/22;
(Continued)

(56) References Cited

U.S. PATENT DOCUMENTS 4,481,593 A * 11/1984 Bahler ..... G10L 15/05 704/253
4,489,434 A * 12/1984 Moshier ..... G10L 15/00 704/239
(Continued)

FOREIGN PATENT DOCUMENTS

JP 2008-170592 A 7/2008
JP 2012-083569 A 4/2012

OTHER PUBLICATIONS

Sakonda, N. (2013). "Brother's Realtime Vocal Synthesis Performing System: the overview and background," Nagoya University of Arts and Sciences, School of Media and Design/Research Bulletin 2013, vol. 6, Department of Visual Media, Professor, Partial English translation, 15 pages.
(Continued)

*Primary Examiner* — Marivelisse Santiago Cordero
*Assistant Examiner* — Stephen Brinich
(74) *Attorney, Agent, or Firm* — Morrison & Foerster LLP

(57) ABSTRACT

A desired character train included in a predefined reference character train, such as lyrics, is set as a target character train, and a user designates a target phoneme train that is indirectly representative of the target character train by use of a limited plurality of kinds of particular phonemes, such as vowels and a particular consonants. A reference phoneme train indirectly representative of the reference character train by use of the particular phonemes is prepared in advance. Based on a comparison between the target phoneme train and the reference phoneme train, a sequence of the particular phonemes in the reference phoneme train that matches the target phoneme train is identified, and a character sequence in the reference character train that corresponds to the identified sequence of the particular phonemes is identified.
(Continued)

The thus-identified character sequence estimates the target character train.

12 Claims, 5 Drawing Sheets

(51) Int. Cl.
*G10H 7/02* (2006.01)
*G10L 13/033* (2013.01)

(52) U.S. Cl.
CPC ..... *G10H 2220/221* (2013.01); *G10H 2250/455* (2013.01); *G10L 13/0335* (2013.01)

(58) Field of Classification Search
CPC ..... G10L 15/26; G09B 17/006; G09B 19/04; G09B 5/06; G09B 17/00
USPC ..... 704/1–10, 231, 275, 255, 235, 257, 260, 704/270, E15.001
See application file for complete search history.

(56) References Cited

U.S. PATENT DOCUMENTS 5,890,115 A * 3/1999 Cole ..... G10H 7/02 704/258
6,847,931 B2 * 1/2005 Addison ..... G10L 13/10 704/260
2001/0046658 A1 * 11/2001 Wasowicz ..... G09B 5/065 434/167
2003/0216918 A1 * 11/2003 Toyama ..... G10L 15/22 704/254
2004/0158464 A1 * 8/2004 Baker ..... G10L 15/083 704/231
2007/0009865 A1 * 1/2007 Palacios ..... G09B 19/04 434/167
2008/0304672 A1 * 12/2008 Yoshizawa ..... G08G 1/017 381/56
2009/0012787 A1 * 1/2009 Itoh ..... G10L 15/26 704/235
2010/0174546 A1 * 7/2010 Kim ..... B25J 13/003 704/275

OTHER PUBLICATIONS

Yamamoto, K. et al. (Apr., 2013). "The Development of a Text Input Interface for Realtime Japanese Vocal Keyboard," 2013 Information Processing Society of Japan, vol. 54, No. 4, with translation of abstract, pp. 1373-1382.

* cited by examiner

ESTIMATION OF TARGET CHARACTER TRAIN

FIELD OF THE INVENTION

The present invention relates generally to techniques for estimating, based on indirect designation of a desired character train (i.e., target character train), substance of the designated character train (i.e., target character train), and more particularly to permitting indirect designation of a desired character train with a simple method.

BACKGROUND OF THE INVENTION

There have heretofore been known apparatus which generate singing voices by synthesizing voices of lyrics while varying a pitch in accordance with a melody. Japanese Patent Application Laid-open Publication No. 2008-170592 (hereinafter referred to as "Patent Literature 1"), for example, discloses a technique which, in response to MIDI messages being sequentially supplied from a performance data generation apparatus, sequentially updates a current singing position on the basis of prestored lyric data. Further, Japanese Patent Application Laid-open Publication No. 2012-083569 (hereinafter referred to as "Patent Literature 2") discloses a technique which, in response to phonogram data being output, sequentially reads out scale note data from a melody storage area and synthesizes voices of phonograms indicative by the phonogram data and having scale notes (pitches) indicated by the scale note data read out from the melody storage area.

Further, in "The Development of a Text Input Interface for Realtime Japanese Vocal Keyboard" co-authored by Kazuhiko YAMAMOTO, Shota KAGAMI, Keizo HAMANO, and Kazuki KASHIWASE, Transaction of Information Processing Society of Japan, Vol. 54, No. 4, pp 1373-1382 (2013) (hereinafter referred to as "Non-patent Literature 1"), a keyboard musical instrument is disclosed which designates, one by one, characters of lyrics (lyrics characters) comprising Japanese alphabetical letters (or characters), while combining vowel keys, consonant keys and voiced sound symbol keys. Furthermore, in the overview and background of "Brother's Realtime Vocal Synthesis Performing System" by Noriyasu SAKODA in research bulletin of Nagoya University of Arts and Sciences, Art and Design Department, pp 21-33 (2013) (hereinafter referred to as "Non-patent Literature"), a musical instrument is disclosed in which a plurality of characters are allocated to a group of performance instructing buttons of an accordion and in which lyrics can be designated, one character by one character, through operations of desired ones of the buttons.

In the conventionally-known apparatus which generate voices on the basis of characters, such as singing voice generation apparatus, it has been difficult to designate desired characters through simple operations. More specifically, according to the disclosure of Non-patent Literature 1, lyrics are caused to automatically progress in synchronism with a progression of a music piece performance (tones). Further, according to the disclosure of Non-patent Literature 2, a melody is caused to automatically progress in synchronism with a progression of lyrics. Namely, according to each of the disclosed techniques in Non-patent Literature 1 and Non-patent Literature 2, voice generation of a character train is performed only in accordance with a progression of the lyrics. Thus, in each of the aforementioned prior art techniques, it is not possible to execute an ad lib performance with a desired melody while selecting characters in a different progression from the sequenced lyrics. Therefore, it is impossible to, for example, change and/or repeat voices of the lyrics in an ad lib fashion.

Further, although the prior art techniques disclosed in Non-patent Literature 1 and Non-patent Literature 2 allow characters of lyrics to be freely designated, the technique disclosed in Literature 1 is unsatisfactory in that it requires complicated character designating operations, and the technique disclosed in Literature 2 is unsatisfactory in that there are an extremely great number of character designating choices. Thus, with these techniques, it is difficult to perform selection operations such that desired lyrics can be generated at a practical progression speed of a music piece performance (tones).

SUMMARY OF THE INVENTION

In view of the foregoing prior art problems, it is an object of the present invention to provide an improved technique which allows a desired portion (target character train) of a predefined character train, such as lyrics, to be indirectly designated with a simple method, and which can accurately estimate the substance of the designated target character train.

In order to accomplish the above-mentioned object, the present invention provides an improved apparatus for estimating a target character train from a predefined reference character train, which comprises a processor configured to: acquire a reference phoneme train related to the predefined reference character train, the reference phoneme train being indirectly representative of the reference character train by use of a limited plurality of kinds of particular phonemes; acquire a target phoneme train indirectly representative of the target character train by use of the particular phonemes; and identify, based on a comparison between the target phoneme train and the reference phoneme train, a character sequence in the reference character train that corresponds to a sequence of the particular phonemes in the reference phoneme train matching the target phoneme train.

According to the present invention, a desired target character train is designated indirectly by a target phoneme train, indirectly representative of the target character train, by use of the limited plurality of kinds of particular phonemes, rather than being designated directly. A reference phoneme train related to the predefined reference character train is also indirectly representative of the reference character train by use of the limited plurality of kinds of particular phonemes. The processor acquires the desired target phoneme train, indirectly representative of the reference character train, for example on the basis of user's selection operations. Then, based on a comparison between the target phoneme train and the reference phoneme train, the processor identifies a character sequence in the reference character train that corresponds to a sequence of the particular phonemes in the reference phoneme train matching the target phoneme train. Because relationship between the reference character train and the reference phoneme train is known beforehand, the character sequence in the reference character train that corresponds to the sequence of the particular phonemes in the reference phoneme train matching the target phoneme train can be readily identified. The thus-identified character sequence in the reference character train can be estimated as corresponding to the target character train that corresponds to the target phoneme train.

The present invention arranged in the above-described manner can estimate the substantive target character train on the basis of the target phoneme train indirectly representative of the target character train. Further, because such a target phoneme train is represented by use of the limited plurality of kinds of particular phonemes, the number of kinds of phonemes that become objects of selection when the user designates a target phoneme train can be reduced significantly, so that the necessary selection operations can be performed by the user easily and quickly. Assuming that the plurality of kinds of particular phonemes mainly comprises vowels, it would be only necessary for the user to perform selection operations on about character keys allocated to about five vowels. This means that the user only has to perform selection operations considerably simplified and facilitated as compared to a conventional case where the user performs ordinary character input through selection operations, for example, on keys of twenty six alphabetic characters. For example, the user can quickly select desired ones of the plurality of kinds of particular phonemes by blind touch by slightly moving fingers of his or her one hand without moving the one hand. Thus, in a case where the present invention is applied to a music-related apparatus and the user should designate in real time a character train designating singing voices to be generated in accordance with a progression of a music piece performance, the user can perform operations for designating a character train in real time so that desired singing voices can be generated at a progression speed of the music piece performance (tones). The present invention is also suited for an application where the user designates a partial lyrics phrase in an ad lib fashion during a music piece performance and thereby causes voices to be generated for the designated partial lyrics phrase.

In an embodiment, the particular phonemes may include vowels, and one or more consonants. What kinds of phonemes should be specifically included in the particular phonemes depends on a language system handled in an apparatus provided with the present invention. Because the vowels appear with a high frequency in any words in any language systems, including the vowels in the particular phonemes should be very useful irrespective of the language system handled. The kind of the particular consonant to be included in the particular phonemes, on the other hand, may depend more or less on the language system handled. Typically, the particular consonant may be a consonant that can constitute one clear block of syllable without being combined with a vowel in the language system in question. Thus, where original syllables cannot be represented by the vowels alone, they can be represented using the particular consonant. In the Japanese language, for example, the consonant "n" can by itself constitute a significant or meaningful syllable, and thus, including the consonant "n" in the particular phonemes is very useful and helpful.

In an embodiment, the apparatus of the present invention may further comprise a selector for selecting any one of the particular phonemes in response to a user operation. In this case, the processor is configured to acquire, as the target phoneme train, a phoneme train time-serially input from the selector in response to user operations. As an example, in a case where the apparatus of the present invention is applied to an electronic musical instrument, a part of a pitch-designating operator group or unit (i.e., a group of pitch selectors), such as a keyboard of the electronic musical instrument, may be used as the selector. With such arrangements, the user can perform input operations for designating a desired target phoneme train in a similar operating style to that employed in a performance of the musical instrument. Further, by writing, on a musical score, pitches corresponding to the pitch-designating operators (pitch selectors) having the particular phonemes allocated thereto, an operational procedure of the pitch-designating operators pitch-designating operators for designating a target phoneme train corresponding to a predetermined target character train can be recorded in writing. Such recording in writing allows an operational procedure for designating a target phoneme train to be transferred to a third person in an objective way and allows the user to practice. Note that, with the construction where the particular phonemes are allocated to some of the pitch-designating operators in a single musical instrument as above, the user can designate, while designating characters (lyrics) by use of the particular-phoneme-allocated pitch-designating operators, pitches of voices corresponding to the characters by use of the other pitch-designating operators.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

(1) System Configuration

Figure 1A:
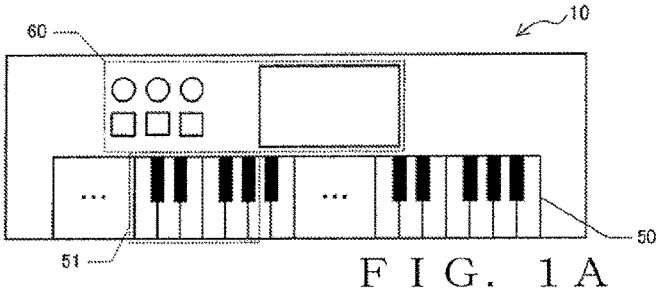
FIG. 1A is a schematic view of an electronic keyboard instrument provided with an embodiment of a target character train estimation apparatus of the present invention.

FIG. 1A is a schematic view of an electronic keyboard instrument 10 provided with an embodiment of a target character train estimation apparatus of the present invention.

The electronic keyboard instrument 10 includes a casing of a generally rectangular cuboid shape, and a pitch selector 50 including a plurality of white keys and a plurality of black keys and an input/output unit 60 are provided on one surface of the casing. The pitch selector 50 is originally an operator unit for designating pitches, but, in the instant embodiment, it is used as an operator unit where some of the keys are used as operators for indirectly designating a desired character train (by directly designating a later-described target phonogram train).

The input/output unit 60 includes an input section that inputs instructions etc. from a user, and an output section (display and speaker) that outputs various information (image information and voice information) to the user. In the illustrated example of FIG. 1A, rotary switches and buttons provided as the input section of the keyboard instrument 10 and an image of a display section provided as the output section of the keyboard instrument 10 are depicted within a broken-line block in FIG. 1A. The user can designate a character and a pitch by selecting, via the input section of the input/output unit 60, a tone color, reference character train information indicative of lyrics of a song to be performed, etc. and operating the tone pitch selector 50. Once the character and the pitch are designated, a voice corresponding to the designated character is output from a sound output section 70 with the designated pitch. Namely, the user can execute a performance where predefined lyrics are sung with desired pitches.

Figure 1B:
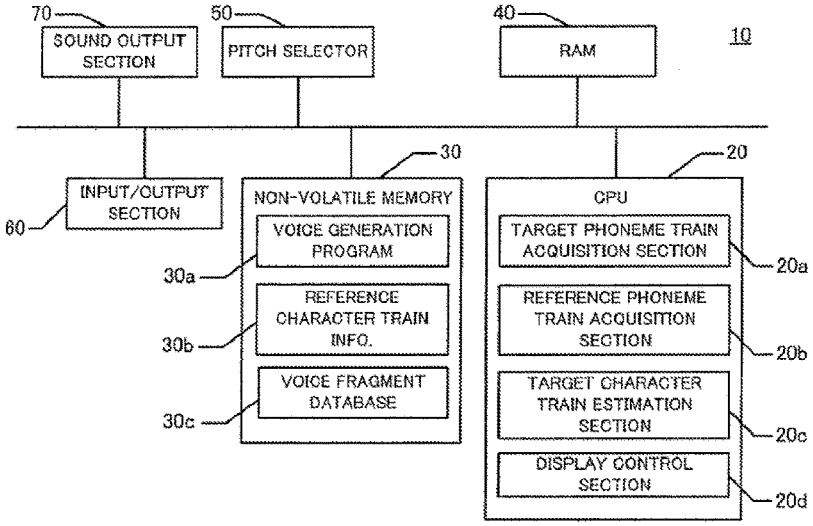
FIG. 1B is a block diagram showing a construction of the keyboard instrument.

FIG. 1B is a block diagram showing a construction of the keyboard instrument 10 for generating and outputting a voice. As shown in FIG. 1B, the keyboard instrument 10 includes a CPU 20, a non-volatile memory 30, a RAM 40, the pitch selector 50, the input/output unit 60, and the sound output section 70. The sound output section 70 may include a circuit for outputting a voice, and a speaker (not shown in FIG. 1A). The CPU 20 is capable of executing programs, recorded in the non-volatile memory 30, using the RAM 40 as a temporary storage area.

A voice generation program 30*a*, reference character train information 30*b* and a voice fragment database 30*c* are recorded in advance in the non-volatile memory 30. The reference character train information 30*b* is information of a predefined reference character train, such as lyrics. Note that, in the instant embodiment, the reference character train information 30*b* is defined in a text format (i.e., a format where codes indicative of individual characters are arranged in accordance with a character order in the reference character train). The reference character train information 30*b* only needs to be recorded in the non-volatile memory 30 prior to a performance. For example, reference character train information 30*b* generated by the user operating the input/output unit 60 may be recorded in the non-volatile memory 30, or pre-generated reference character train information 30*b* may be recorded in the non-volatile memory 30 via a not-shown interface. Needless to say, one piece of reference character train information 30*b* may be prepared for only one music piece, or a plurality of pieces of reference character train information 30*b* may be prepared for a plurality of music pieces.

Further, the voice fragment database 30*c* comprises data for reproducing human singing voices. In the instant embodiment, the voice fragment database 30*c* is created by collecting waveforms of voices, indicated by characters, when the voices are audibly generated or sounded with reference pitches, segmenting the waveforms into voice fragments of short time periods and compiling waveform data indicative of the voice fragments into a database. Namely, the voice fragment database 30*c* comprises waveform data indicative of a plurality of voice fragments. A voice indicated by a desired character can be reproduced by combining some of the waveform data indicative of voice fragments.

More specifically, the voice fragment database 30*c* comprises a collection of waveform data of transition portions (hereinafter referred to as "articulations"), such as a transition portion from a consonant to a vowel ("CV"), a transition portion from one vowel to another ("VV") and a transition from a vowel to a consonant ("VC"), and stationary portions of vowels. Namely, the voice fragment database 30*c* comprises a collation of voice fragment data indicative of various voice fragments that are used as materials of singing voices. These voice fragment data are data created on the basis of voice fragments extracted from voice waveforms uttered by real humans or persons. In the instant embodiment, voice fragment data to be combined when voices indicated by desired characters and character trains are to be reproduced are determined in advance, and information for identifying voice fragment data to be combined is recorded in the non-volatile memory 30, although not particularly shown in the figures. The CPU 20 selects voice fragment data to be combined by referencing the non-volatile memory 30 in accordance with a desired character or desired character train indicated by the reference character information 30*b*. Then, the voice fragment data selected by the CPU 20 are combined, so that waveform data for reproducing a voice(s) indicated by the desired character or desired character train is generated. Note that a plurality of the voice fragment databases 30C may be provided in corresponding relation to various languages, sexes of voice uttering persons, characteristics of voices, and the like. Also, the waveform data constituting the voice fragment database 30C may each be data acquired by dividing a sample train, obtained by sampling a waveform of a voice fragment at a predetermined sampling rate, into frames each having a predetermined time length, or may each be frame-specific spectral data (data of amplitude spectra and phase spectra) acquired by performing FFT (Fast Fourier Transform) on the data. The instant embodiment will be described in relation to the case where the waveform data are the latter data (i.e., frame-specific spectral data).

Further, in the instant embodiment, the CPU 20 is capable of executing the voice generation program 30*a* recorded in the non-volatile memory 30. In accordance with the executed voice generation program 30*a*, the CPU 20 receives user's designation of a target phoneme train, performs processing for estimating a target character train corresponding to the user-designated target phoneme train, and generating voices indicated by the estimated target character train with pitches designated by the user via the pitch selector 50. Then, the CPU 20 outputs, to the sound output section 70, an instruction for outputting voices in accordance with voice signals. As a consequence, the sound output section 70 generates analog waveform signals for outputting the voices, amplifies the analog waveform signals and outputs the voices through the speaker.

(2) Reference Character Train

In the instant embodiment, a reference character train indicated by the reference character train information 30*b* is divided into groups each comprising a plurality of characters, in order to enhance estimation accuracy of a user-designated character (target character). Such groups can be defined on the basis of a plurality of indices; in the instant embodiment, the reference character train is grouped hierarchically on the basis of a morpheme, phrase and occurrence of repetition. As an example, the minimum unit in character grouping is the morpheme. Namely, all characters included in the reference character train information 30*b* related to one reference character train are grouped on a morpheme-by-morpheme basis that is a significant or meaningful minimum unit (i.e., into morpheme groups). Further, a phrase group is formed in correspondence with a phrase comprising a plurality of morphemes. Such a phrase group may be formed of either phrases comprising sets of grammatical words, or phrases comprising musical segments (segments of a melody).

Further, phrase groups may form a hierarchy. For example, the hierarchy may comprises a layer to which phrase groups each comprising two morphemes belong to, and a layer of upper-order phrase groups each formed by combining the above-mentioned phrase groups. Further, in a case where same characters or same character trains are repeated in succession, a group (repetition group) is formed of information each comprising the character or character train repeated and the number of repetition. Note that the above-mentioned grouping may be performed either artificially by the user or the like or automatically by the CPU 20 of the keyboard instrument 10. In the instant embodiment, the CPU 20 may analyze ungrouped character strain information 30*b* and then group the analyzed character strain information 30*b*. In any case, the instant embodiment of the target character train estimation apparatus is constructed to enhance estimation accuracy of user-designated characters by estimating the user-designated characters from the reference character train on the basis of transition patterns defined based on the groups, as will be described in detail later.

Further, reference phoneme trains are prepared in advance in corresponding relation to individual reference character trains. Each of the reference phoneme trains is indirectly representative of the corresponding reference character train by use of a limited plurality of kinds of particular phonemes, as will be described in detail later. Note that the language (object language) handled in the embodiment to be described below is Japanese. Thus, the limited plurality of kinds of specific phonemes should be determined taking account of characteristics of the object language, i.e. Japanese. Typically, in the case where the object language is Japanese, a total of six kinds of phonemes, consisting of five vowels of "a", "i", "u", "e" and "o" and one particular consonant "n", will be included in the set of particular phonemes. Alternatively, however, any other desired limited plurality of kinds of phonemes may be used as, or included in, the set of particular phonemes depending on the object language. The CPU 20 may generate a reference phoneme train corresponding to a reference character train selected an object of processing and store the generated reference phoneme train into the RAM 40, or, alternatively, reference phoneme trains generated in advance in corresponding relation to individual reference character trains may be recorded in the non-volatile memory 30.

Figure 2A:
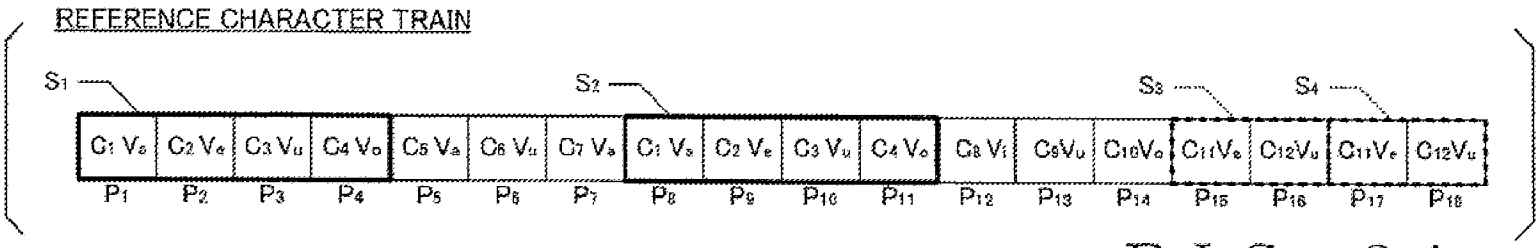
FIG. 2A is a diagram showing an example of a reference character train.

FIG. 2A is a diagram showing an example of a reference character train, which particularly schematically depicts an extracted portion of lyrics, comprising a plurality of character trains, by use of reference marks (the term "reference mark" is used herein to distinguish from the lyrics-related term "reference character"). In FIG. 2A, a Japanese character train extending from left to right (i.e., comprising characters arranged in a left-right direction of the figure) is depicted by use of reference marks, and each rectangular block represents one Japanese alphabetic character called a "Kana" character. However, in FIG. 2A, such Japanese Kana characters are not indicated directly, but indicated by reference marks "$C_1V_a$", "$C_2V_e$", "$C_3V_u$", "$C_4V_o$", etc. In general, the syllable of each Japanese Kana character comprises a combination of a consonant and a vowel. Thus, in each reference mark corresponding to one Japanese Kana character (e.g., "$C_1V_a$") in FIG. 2B, a consonant constituting the syllable of the Japanese Kana character is indicated by "C" and a suffix, and a vowel constituting the syllable of the Japanese Kana character is indicated by "V" and a suffix. For example, reference mark "$C_1$" represents a consonant (e.g., "k") and reference mark "$C_2$" represents another consonant (e.g., "s"); namely, reference mark "C" with different suffixes represent different consonants. Further, let it be assumed that "$V_a$", "$V_i$", "$V_u$", "$V_e$" and "$V_o$" represent vowels "a", "i", "u", "e" and "o", respectively. Further, in the illustrated example of FIG. 2A, rectangular thick-line blocks indicate repetition of a same partial character train in succession or with some interval. For example, a partial character train $S_1$ and a partial character train $S_2$ constitute repetition of a same partial character train, and a partial character train $S_3$ and a partial character train $S_4$ constitute repetition of a same partial character train.

Further, in FIG. 2A, reference characters "$P_1$", "$P_2$", "$P_3$", . . . indicated immediately beneath the individual characters in the reference character train represent positions (generation positions) of the corresponding characters in the reference character train. The character train information 30*b* recorded in the non-volatile memory 30 includes such position data $P_1$, $P_2$, $P_3$, . . . as well. With the position data $P_1$, $P_2$, $P_3$, . . . , the individual characters in the reference character train and the individual phonemes in the corresponding reference phoneme train can be associated with each other in a one-to-one relationship.

Figure 2B:
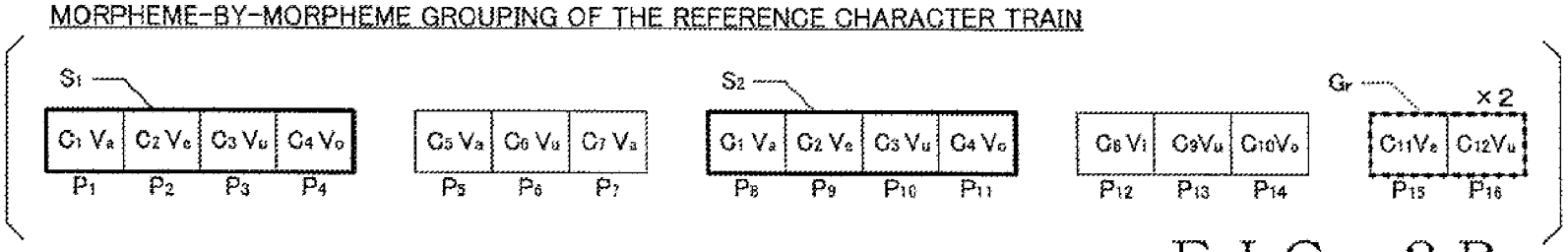
FIG. 2B is a diagram showing example morpheme-by-morpheme grouping of the reference character train.

FIG. 2B shows an example in which the character train shown in FIG. 2A has been grouped on a morpheme-by-morpheme basis. FIG. 2B separately shows different morpheme groups into which the character train shown in FIG. 2A has been grouped, where a partial character train "$C_1V_a$, $C_2V_e$, $C_3V_u$, $C_4V_o$", for example, constitutes one morpheme group. Grouping on a phrase-by-phrase basis is performed by adding appropriate identification information intended for grouping two or more successive morpheme groups constituting one phrase. Grouping based on occurrence of repetition is performed in response to occurrence of repetition in succession of a character train (or character), and thus, in the illustrated example of FIG. 2A, the partial character train $S_1$ and the partial character train $S_2$ that do not occur in succession (i.e., that occur with some interval therebetween) are not grouped, while the partial character train $S_3$ and the partial character train $S_4$ that occur in succession are grouped. Namely, in the illustrated example of FIG. 2B, the partial character train $S_3$ and the partial character train $S_4$ are grouped as a repetition group, and this repetition group can be represented by a combination of the preceding partial character train $S_3$ and repetition information indicative of the number of repetition ("2" in the illustrated example of FIG. 2B). Further, for the partial character train $S_1$ and the partial character train $S_2$ that do not occur in succession, i.e. that occur with some interval therebetween as well, appropriate information indicating that these partial character trains constitute repetition may be added to the character train information 30*b*, because such information can enhance the estimation accuracy of the user-designated target character train.

Figure 2C:
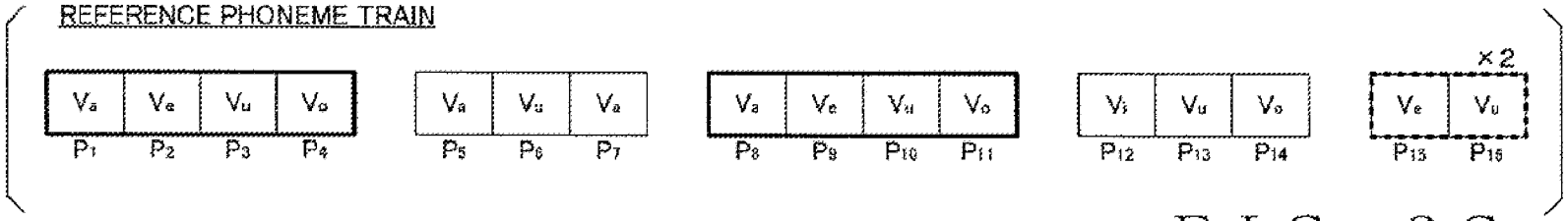
FIG. 2C is a diagram showing a reference phoneme train corresponding to the reference character train shown in FIG. 2B.

Further, FIG. 2C is a diagram showing the reference phoneme train, corresponding to the reference character train, grouped in a manner similar to that shown in FIG. 2B. The term "reference phoneme train" is used herein to refer to a train where the corresponding reference character train is represented by use of the aforementioned six kinds of particular phonemes comprising five vowels "a", "i", "u", "e" and "o" and one particular consonant "n". Thus, the reference phoneme train shown in FIG. 2C comprises data obtained by extracting only the five vowels "a", "i", "u", "e" and "o" and one particular consonant "n" from the individual characters in the reference character train shown in FIG. 2B. The individual phonemes in the reference phoneme train have associated therewith the position data $P_1$, $P_2$, $P_3$, . . . of the corresponding original characters. Thus, the original characters in the reference character train corresponding to the phonemes in the reference character train can be reproduced (identified) with ease on the basis of the position data $P_1$, $P_2$, $P_3$, . . . .

(3) Request for Target Character Train

In the description of the instant embodiment, a desired partial character train which is included in the reference character train and which the user wants to read out (or retrieve) data from the reference character train will be referred to as "target character train". Importantly, in the instant embodiment, the user does not directly designate a desired target character train, but indirectly designates (requests) the desired target character train by designating a phoneme train that is indirectly representative of the target character train by use of the aforementioned six kinds of phonemes comprising five vowels "a", "i", "u", "e" and "o" and one particular consonant "n" (such a phoneme train will hereinafter be referred to as "target phoneme train").

Further, in the instant embodiment of the target character train estimation apparatus, a part of the pitch selector 50 is allocated as operators (particular phoneme selector 51) for designating or selecting a target phoneme train. More specifically, the vowels "a", "i", "u", "e" and "o" are allocated to five white keys corresponding to notes of "C", "D", "E", "F" and "G" located in a range of the pitch selector (keyboard) 50 operable by the left hand of the human player (i.e., user), and the particular consonant "n" is allocated to a black key corresponding to a note of "D#". At least when a request is made for a target character train in accordance with the principles of the present invention, the keys corresponding to the notes "C", "D", "D#", "E", "F" and "G" function as the particular phoneme selector 51, without functioning as pitch designating keys. Such arrangements allow the human player or user to manipulate or operate the particular phoneme selector 51 with individual fingers of his or her one hand without moving the one hand. Thus, the arrangements are well suited for blind-touch operations, so that the human player can perform simple and quick operations.

In the Japanese language, any one of the vowels "a", "i", "u", "e" and "o" is included in utterances (or syllables) of almost all of the characters. Thus, with the above-described construction of the instant embodiment, at least some of the phonemes included in the utterances (or syllables) of almost all of the characters can be designated with the white keys having the vowels allocated thereto. Further, in the Japanese language, an utterance (or syllable) consisting of the consonant "n" alone is the only exception of syllable that cannot be represented using a vowel. Thus, at least some of the phonemes included in utterances (or syllables) of almost all of the characters can be designated with the aforementioned six kinds of phonemes.

The number of characters used in each one of various languages is typically several dozen, and thus, if characters are selected one by one, then the number of objects of selection (i.e., choices) would become extremely large. By contrast, in the case where character selection is made from a limited plurality of kinds of particular phonemes as in the instant embodiment, the number of choices can be reduced to an extremely small number ("6" in the aforementioned example) as compared to the case where all the characters are made objects of selection. The user can indirectly designate his or her desired character in real time using the particular phoneme selector 51. Namely, the user recognizes a vowel (or particular consonant) of the desired character and selects the recognized vowel (or particular consonant) via the particular phoneme selector 51. However, because there are a plurality of characters where a same vowel is included in different syllables of the character, there can be a plurality of candidates of a character train (i.e., candidate character trains) corresponding to a user-designated target phoneme train. Thus, the CPU 20 in the instant embodiment is constructed to estimate a character train from the reference character train through processing by the voice generation program 30*a*.

(4) Configuration of the Voice Generation Program

For the aforementioned purpose, the voice generation program 30*a* includes a plurality of program modules that are a target phoneme train acquisition section 20*a*, a reference phoneme train acquisition section 20*b*, a target character train estimation section 20*c* and a display control section 20*d*, and such program modules cause the CPU 20 to perform predetermined functions. More specifically, in response to user's operations on the particular phoneme selector 51, the target phoneme train acquisition section 20*a* causes the CPU 20 to perform a function for acquiring a target phoneme train indirectly representative of the target character train. Namely, through processing by the target phoneme train acquisition section 20*a*, the CPU 20 receives a user's selection operation designating a desired phoneme of the aforementioned six kinds of particular phonemes on the basis of an output signal from the particular phoneme selector 51. As another example, the target phoneme train acquisition section 20*a* may acquire a target phoneme train indirectly representative of the target character train, by another suitable means, such as a remote request via a communication network.

The reference phoneme train acquisition section 20*b* causes the CPU 20 to perform a function for acquiring a reference phoneme train related to one reference character train selected as an object of processing. For example, in a case where such a reference phoneme train related to one reference character train selected as an object of processing is generated through pre-processing by the CPU 20, the CPU 20, through processing by the reference phoneme train acquisition section 20*b*, references the reference character train information 30*b* to analyzes the aforementioned six kinds of phonemes (vowels "a", "i", "u", "e" and "o" and one particular consonant "n") from a syllable structure of each character in the reference character train, and then converts, on the basis of such analysis, the reference character train into a reference phoneme train represented by the six kinds of particular phonemes. FIG. 2C shows a reference phoneme train generated from the grouped reference character train shown in FIG. 2B. Alternatively, in a case where the non-volatile memory 30 has recorded therein a plurality of reference phoneme trains generated in advance in association with respective ones of a plurality of reference character trains, the reference phoneme train acquisition section 20*b* may acquire, from the non-volatile memory 30, one of the recorded reference phoneme trains that corresponds to any one of the reference characters train selected as an object of processing.

The target character train estimation section 20*c* causes the CPU 20 to perform a function for estimating a target character from the reference character train on the basis of a comparison between the target phoneme train and the reference phoneme train. More specifically, the target character train estimation section 20*c* causes the CPU 20 to perform a function for identifying a sequence of characters in the reference character train that corresponds to a sequence of the particular phonemes in the reference phoneme train matching the target phoneme train.

(5) Processing by the Voice Generation Program

Next, an example of target character train estimation processing performed by the CPU 20 in accordance with the voice generation program 30*a* will be described with reference to FIG. 4A. Let it be assumed here that, prior to the target character train estimation processing, the CPU 20 generates a reference phoneme train from a reference character train set as an object of processing (object-of-processing reference character train) through the processing by the reference phoneme train acquisition section 20*b* and thereby acquire the reference phoneme train necessary for the estimation processing. This estimation processing is processing performed in accordance with the target phoneme train acquisition section 20*a* and the target character train estimation section 20*c*.

For example, in accordance with desired singing timing, the user sequentially designates, via the particular phoneme selector 51, target phonemes corresponding to a desired target character train in the object-of-processing reference character train. The estimation processing shown in FIG. 4A is performed each time one target phoneme is designated through a user operation on the phoneme selector 51. Namely, once the particular phoneme selector 51 is operated by the user to designate one target phoneme, the CPU 20 starts the estimation processing shown in FIG. 4A, where it acquires data of the target phoneme designated by the user's operation on the phoneme selector 51 and then stores the acquired data of the target phoneme into a target phoneme train storing buffer (step S100). In this manner, data of sequentially-designated target phonemes are sequentially stored into the target phoneme train storing buffer.

Then, on the basis of a comparison between the reference phoneme train and the target phoneme train stored in the target phoneme train storing buffer, the CPU 20 performs the function for identifying a sequence of characters in the reference character train that corresponds to a sequence of the particular phonemes in the reference phoneme train matching the target phoneme train (step S110). As an example, for the matching at step S110, the CPU 20 performs: a process for identifying one or more transitive phoneme sequences in the reference phoneme train that match the sequence of the particular phonemes in the target phoneme train (step S111); a process for assigning an evaluation value to each of the identified transitive phoneme sequences in accordance with a degree of accuracy of arrangement of the particular phonemes in the transitive phoneme sequence (step S112); and a process for identifying a character sequence in the reference character train that corresponds to any one of the transitive phoneme sequences that has been assigned a relatively high evaluation value (step S113). Here, the term "transitive phoneme sequences" refers to a phoneme sequence comprising an accurate arrangement of the particular phonemes, a phoneme sequence comprising a slightly disordered arrangement of the particular phonemes, etc. in the reference phoneme train. Each of the transitive phoneme sequences can be identified in the reference phoneme train, which is an object of comparison, by applying, as templates, several transition patterns as noted below to adjoining two phonemes. Note that information indicative of the one or more transitive phoneme sequences identified as candidates at step S111 above is buffered into the RAM 40 and then used in the process of step S111 that is executed in response to user's designation of a next target phoneme via the phoneme selector 51.

More specifically, in the instant embodiment, patterns where a character transits over one or more characters are predefined as a plurality of transition patterns in the reference character train. Here, the "transition" is a concept that permits movement of characters in the reference character train (in other words, reference phoneme train) and thereby allows for a matching process on a target phoneme train, and various numbers and directions may be defined as the number of transited-by characters (i.e., the number of characters by which the transition has occurred) and directions of the transition (i.e., a direction along an order of characters in the character train (i.e., forward or along-the-order direction) and another direction opposite the along-the-order direction (i.e., opposite direction). Because, such various numbers and directions of transition permit estimation, as target character trains, not only character sequences in the reference character train which comprise accurate arrangements of characters but also character sequences in the reference character train which comprise slightly-disordered arrangements of characters. Thus, such various numbers and directions of transition permit estimation of an ad-lib like target character train slightly deviated from the reference character train and estimation of a target character train containing a slight input error. Note that "transition by zero character" means staying at a same position without moving to a next character, "transition by one character" means moving to an immediately preceding or succeeding character, and "transition by two characters" means skipping over one character to a next character in a front-rear direction. "transition by three or more characters" too can be defined similarly to the aforementioned. The "transition pattern", which can be defined on the basis of various factors, is defined in the instant embodiment on the basis of relationship between positions, in the reference character train, of a transitioned-from character and a transitioned-to character), the number of characters over which the transition has occurred, a direction of the transition (forward or along-the-order direction or the opposite direction), attributes of the transitioned-from character and transitioned-to character (i.e., positions, in a group, of the transitioned-from character and transitioned-to character, or whether the characters are at the head of the group), etc.

Among examples of the transition patterns are:

A. transition in the forward direction of the reference character train;

B. repetition of a same group;

C. transition from a given character train to a character following the same character train located at a different position from the given character train;

D. transition by two or more characters within a same group;

E. transition to a different group; and

F. transition to a character not present in the reference character train.

Note that C above (i.e., the C-type transition pattern from a given character train to a character following the same character train located at a different position from the given character train) refers to, for example, a transition in the illustrated example of FIG. 2B from the last character "$C_4V_o$" in the character train $S_1$ to a character "$C_8V_i$" immediately following the same character train $S_2$ located at a different position from the character train $S_1$. Further, F above (transition to a character not present in the reference character train) refers to a transition effected when the user has performed an erroneous operation following designation of a certain character.

Needless to say, these transition patterns may be further subdivided. Even for the repetition of a same group noted in item B (B-type transition pattern), the transition pattern may be subdivided; in the illustrated example of FIG. 2B, a group $G_r$ and another group (immediately-following group) where repetition is occurring may be subdivided into different transition patterns. Further, for the transition by two or more characters within a same group noted in item D above (D-type transition pattern), the transition pattern may be subdivided in accordance with the number of transited-by characters (i.e., the number of characters by which the transition has occurred, direction of the transition, a degree of similarity between character trains around the transited-from character (i.e., character at the transit-starting position) and the transited-to character (i.e., character at the transit-ending or transit-destination position), a position, in the group, of the transited-to character (i.e., whether the transited-to character is at the head of the group, etc. Furthermore, for the transition to a different group noted in item E above (E-type transition pattern), the transition pattern may be subdivided in accordance with a position, in the group, of a transitioned-to character, positional relationship of the group (e.g., whether the group is the head group of various groups included in existing character sets, such as first and second verses, of a music piece), etc.

Further, in the instant embodiment, for each transition pattern, a probability with which one character currently designated by the user transits from the last designated character in that transition pattern is defined in advance as a transition probability (transition evaluation value), and information indicative of the transition probabilities of the individual transition patterns is recorded in the non-volatile memory 30, although not particularly shown. As long as the transition probabilities reflect degrees of the probabilities with which the respective transition patterns occur, they may be defined in any of various manners; for example, they may be defined by measuring the number of occurrence of each one of the transition patterns, or by considering that the probabilities with which the individual transition patterns occur are distributed, for example, in normal distribution. Note that, in this specification, it is assumed that the A-type transition pattern above presents the highest transition probability, and that the B-type, C-type, D-type, E-type and F-type transition patterns decrease in the order they were mentioned. The transition probabilities function as the evaluation values for the transition patterns. Because the A-type transition pattern comprises an accurate arrangement of characters in the reference character train (in other words, an accurate arrangement of particular phonemes in the reference phoneme train), the transition probability (transition evaluation value) of the A-type transition pattern is set high. Because the other transition patterns have lower degrees of accuracy of arrangement of characters in the reference character train (in other words, lower degrees of accuracy of arrangement of particular phonemes in the reference phoneme train), their transition probabilities (transition evaluation values) are set relatively low.

Thus, through the processing by the target character train estimation section 20*c*, the CPU 20 determines, for each of the transition patterns, whether a transition of target phonemes in the current target phoneme train stored in the target phoneme train storing buffer corresponds to that transition pattern and whether the transition pattern is present in the reference character train (in other words, present in the reference phoneme train). If the transition of target phonemes in the current target phoneme train stored in the target phoneme train storing buffer corresponds to the transition pattern and the transition pattern is present in the reference character train, the CPU 20 identifies a transitive phoneme sequence in the reference character train (in other words, in the reference phoneme train) corresponding to the transition pattern (step S111). Then, per each of the transition patterns, the transition probability (i.e., transition evaluation value) defined for the transition pattern corresponding to the identified transitive phoneme sequence is assigned to the identified transitive phoneme sequence (step S112). Information indicative of the identified transitive phoneme sequence (particularly position data) and the corresponding transition probability (i.e., transition evaluation value) are stored into the RAM 40 by the CPU 20. As a specific example of step S112, for each of the transitive phoneme sequences, the CPU 20 assigns a transition probability (i.e., transition evaluation value) to every adjoining two phonemes in the transitive phoneme sequence in accordance with a transition pattern thereof and then generates an overall evaluation value of the transitive phoneme sequence by synthesizing or combining the individual transition probabilities (i.e., transition evaluation values), as will be described in detail later. Then, the CPU 20 identifies an arrangement of characters (character sequence) in the reference character train that corresponds to a transitive phoneme train having been assigned a relatively high transition probability (i.e., transition evaluation value) (step S113).

Let it be assumed here that the processes of steps S111 to S113 are performed in response to user's designation of two or more target phonemes. Note that, when the user has designated the first target phoneme, the CPU 20 performs a special operation without performing the processes of steps S111 to S113 because a target phoneme train acquired at this time point comprises only one phoneme. Namely, through the processing by the target character train estimation section 20*c*, the CPU 20 estimates a user-designated character on the basis of the one target phoneme in accordance with a predetermined rule. This predetermined rule may be determined in a desired manner. For example, the first-designated target phoneme may be estimated to be designation of a character located at a position that appears earliest in the reference character train. Alternatively, the first-designated target phoneme may be estimated to be designation of a character located at a position of the target phoneme in one of a plurality of groups that appears earliest in the reference character train.

(6) Example of Target Character Train Estimation

Figure 3:
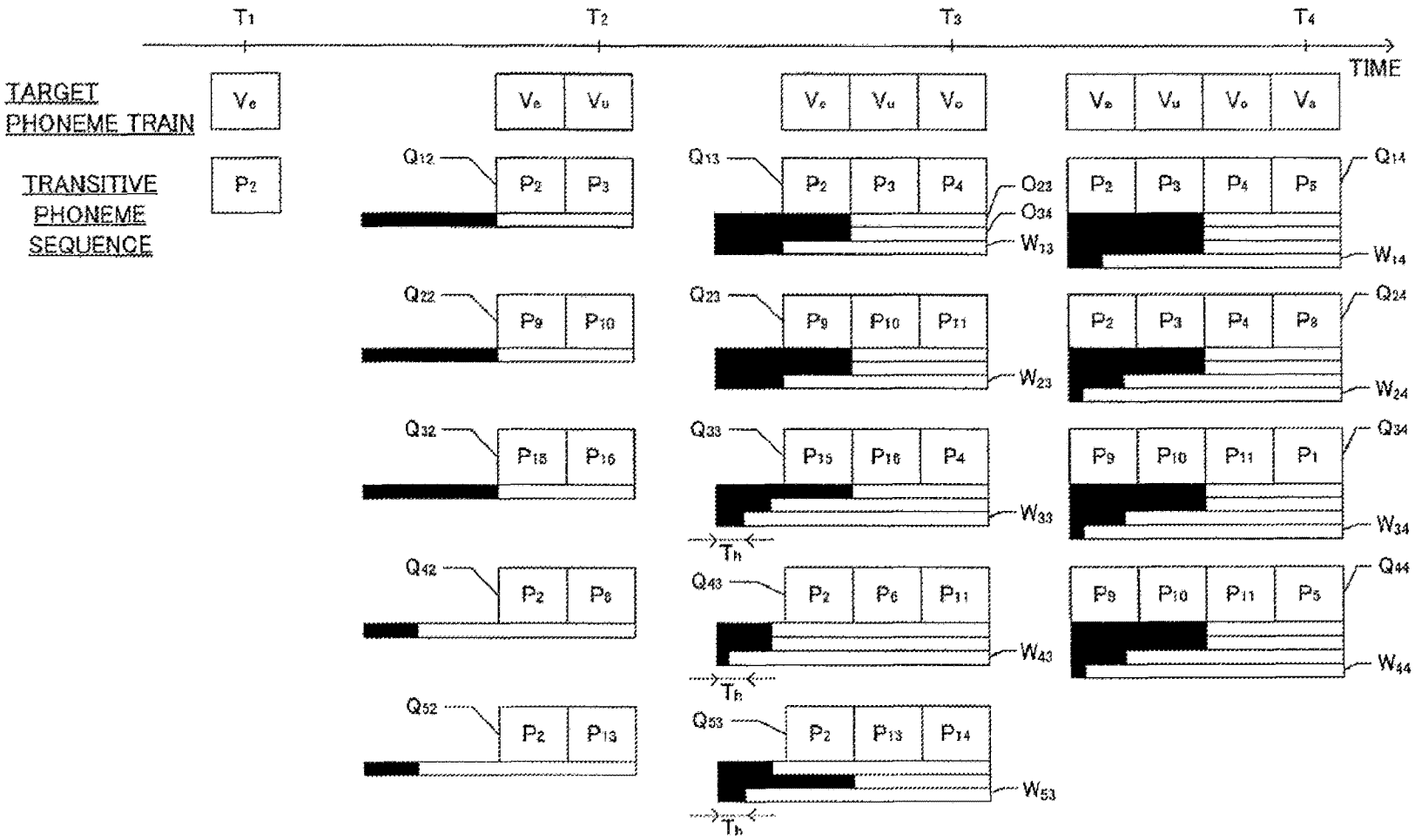
FIG. 3 is a diagram showing an example manner in which a target phoneme train is designated (acquired) over time, one or more transitive phoneme sequences identified in correspondence with the target phoneme train, and example evaluation values (transition probabilities) assigned to the transitive phoneme sequences.
Figure 4A:
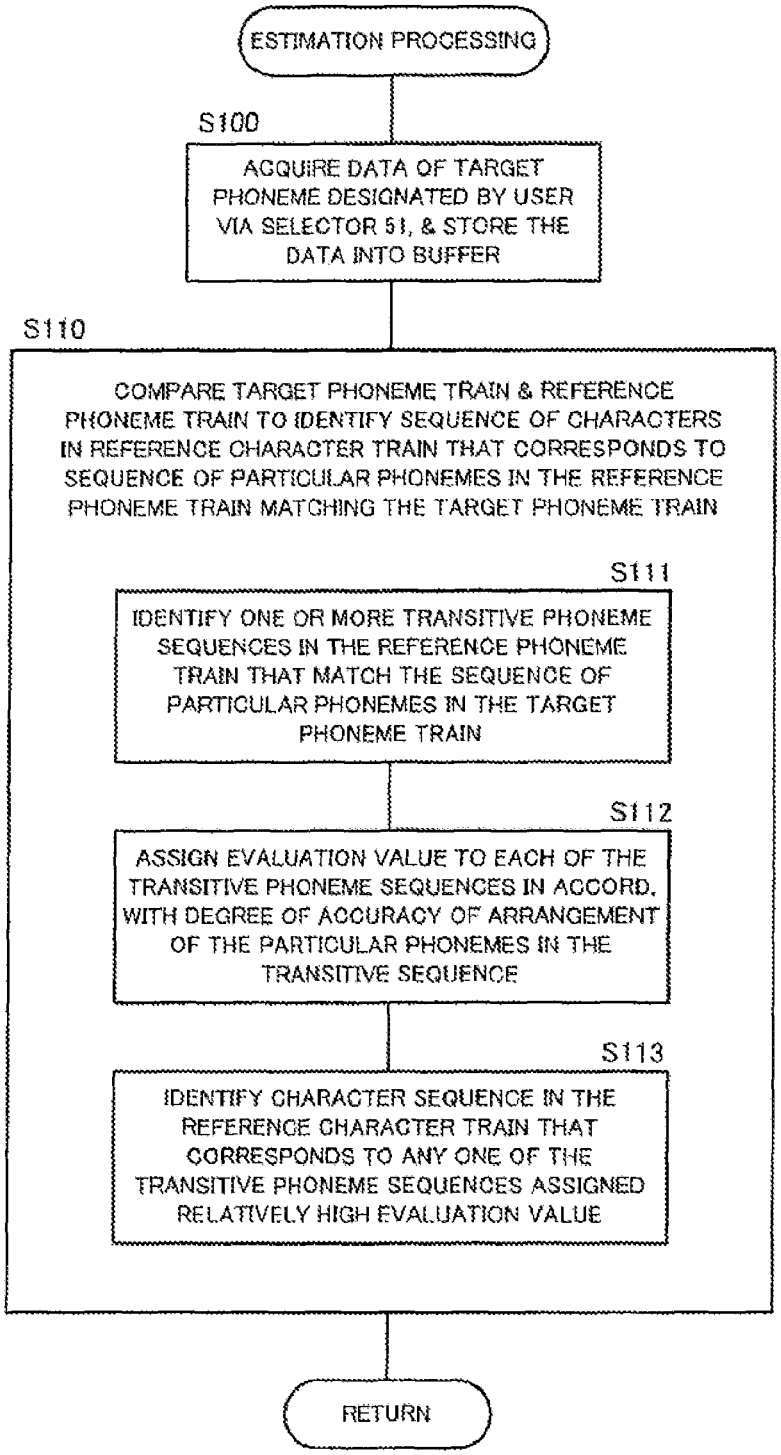
FIG. 4A is a flow chart showing an example of estimation processing performed by a processor.

The following describe, with further reference to FIG. 3, a specific example of target character train estimation performed by the estimation processing of FIG. 4A. FIG. 3 shows a case where, with respect to the reference character train and the reference phoneme train shown in FIGS. 2A to 2C, the user has sequentially designated "Ve", "Vu", "Vo" and "Va", as target phonemes indirectly designating a desired target character train, at time points $T_1$, $T_2$, $T_3$ and $T_4$ via the particular phoneme selector 51. In a "target phoneme train" section in FIG. 3 are shown storage states of the target phoneme train storing buffer at these time points $T_1$, $T_2$, $T_3$ and $T_4$. Namely, data indicative of the designated target phonemes "Ve", "Vu", "Vo" and "Va" are sequentially stored into the target phoneme train storing buffer through the aforementioned operation of step S100. FIG. 3 also shows states of a plurality of transitive phoneme sequences identified or taken out at the four time points $T_1$, $T_2$, $T_3$ and $T_4$ through the process of step S111. Further, in each "transitive phoneme sequence" section in FIG. 3, each particular phoneme included in the transitive phoneme sequence is indicated by a mark (P and a suffix) indicative of a position, in the reference character train, of a character corresponding to the particular phoneme.

Further, in the illustrated example of FIG. 3, the user designates "$V_e$" (i.e., vowel "e") as the first target phoneme at time point $T_1$, and the CPU 20 receives and stores the first designated target phoneme "$V_e$" into the target phoneme train storing buffer (step S100). In this example, it is assumed that the aforementioned rule to be applied to the first designated target phoneme is the one in accordance with which the first-designated target phoneme is estimated to be designation of a character located at a position that appears earliest in the reference character train. In this case, the CPU 20 identifies that the second phoneme "$V_e$" (at position $P_2$) in FIG. 2C is the user-designated target phoneme and assumes that the character (target phoneme) designated first by the user is the second character "$C_2V_e$" (at position $P_2$) in the reference character train. Note that the position of the thus-assumed first-designated character is changeable to another position by combination with the second target phoneme.

Then, once the user designates "$V_u$" as the second target phoneme at time point $T_2$ via the particular phoneme selector 51, the CPU 20 receives and stores the second designated target phoneme "$V_u$" into the target phoneme train storing buffer (step S100), so that a target phoneme train "$V_e$", "$V_u$" is retained in the target phoneme train storing buffer. Namely, at the current time point, the target phoneme train comprising two particular phonemes "$V_e$" and "$V_u$" has been acquired as a whole. Then, through the process of step S111, the CPU 20 identifies one or more transitive phoneme sequences in the reference phoneme train that match the particular phonemes sequence "$V_e$" and "$V_u$" in the target phoneme train "$V_e$", "$V_u$" having been acquired in the target phoneme train storing buffer at the current time point. Then, through the process of step S112, the CPU 20 assigns a respective transition evaluation value to each of the identified transitive phoneme sequences in accordance with a degree of accuracy of arrangement of the particular phonemes in the identified transitive phoneme sequence, i.e. determines a transition probability in accordance with the type of the transition pattern in question. As a specific example of the process of step S112 in the instant embodiment, the CPU 20 assigns a transition evaluation value (transition probability) to every adjoining two phonemes in the transitive phoneme sequence in accordance with a transition pattern thereof and then generates an overall evaluation value of the transitive phoneme sequence by combining the individual transition evaluation values. At the time point when the second target phoneme have been acquired as above, synthesis or combination of the transition evaluation values (transition probabilities) is not necessary because there is only one pair of adjoining phonemes.

In the reference phoneme train shown in FIG. 2C, transitive phoneme sequences matching the target phoneme train "$V_e$", "$V_u$" include: three transitive phoneme sequences corresponding to the aforementioned A-type transition pattern, i.e. a sequence comprising positions $P_2$ and $P_3$, a sequence comprising positions $P_9$ and $P_{10}$, and a sequence comprising positions $P_{15}$ and $P_{16}$; and two transitive phoneme sequences corresponding to the aforementioned transition pattern E, i.e. a sequence comprising positions $P_2$ and $P_{13}$, and a sequence comprising positions $P_2$ and $P_{13}$. Thus, through the process of step S111, the CPU 20 identifies these five transitive phoneme sequences and stores the identified five transitive phoneme sequences. Namely, these five transitive phoneme sequences are candidates from which can be identified the target character train indirectly designated by the target phoneme train having been designated at the current time point.

In FIG. 3, the above-mentioned five transitive phoneme sequences identified and stored in response to acquisition of the target phoneme at time point T2 are indicated by reference marks $Q_{12}$, $Q_{22}$, $Q_{32}$, $Q_{42}$ and $Q_{52}$, respectively. Further, in FIG. 3, example evaluation values assigned to the transitive phoneme sequences $Q_{12}$, $Q_{22}$, $Q_{32}$, $Q_{42}$ and $Q_{52}$ are indicated by rectangular graphic indicators immediately beneath the respective transitive phoneme sequences. In each of the graphic indicators, a total of a while rectangular portion and a black rectangular portion indicates 100% (i.e., probability of "1"), and the black rectangular portion indicates a transition probability (transition evaluation value) of the corresponding transitive phoneme sequence. For example, the transition probability of each of the higher-order three transitive phoneme sequences $Q_{12}$ to $Q_{32}$ corresponding to the above-mentioned A-type transition pattern is about 50% (i.e., probability of "½"), and the transition probability of each of the lower-order two transitive phoneme sequences $Q_{42}$ and $Q_{52}$ corresponding to the above-mentioned transition pattern E is about 20% (i.e., probability of "⅕"). Thus, the higher-order three transitive phoneme sequences $Q_{12}$ to $Q_{32}$ are each greater in evaluation value than the lower-order transitive phoneme sequences $Q_{42}$ and $Q_{52}$, so that the degree of accuracy of arrangement of the particular phonemes in each of the three transitive phoneme sequences $Q_{12}$ to $Q_{32}$ is determined to be higher than that in each of the transitive phoneme sequences $Q_{42}$ and $Q_{52}$. Note that the transition probability (transition evaluation value) determined for adjoining two phonemes in each of the transitive phoneme sequences is stored for use in determining an overall evaluation value of the transitive phoneme sequence.

Then, once the user designates the third target phoneme "$V_o$" at time point $T_3$ via the particular phoneme selector 51, the CPU 20 receives and stores the designated target phoneme "$V_o$" into the target phoneme train storing buffer (step S100), so that a target phoneme train "$V_e$", "$V_u$", "$V_o$" is retained in the target phoneme train storing buffer. Namely, at the current time point, the target phoneme train comprising three particular phonemes "$V_e$", "$V_u$" and "$V_o$" has been acquired as a whole; namely, the target phoneme train has been updated at time point $T_3$. Then, through the process of step S111, the CPU 20 identifies one or more transitive phoneme sequences in the reference phoneme train that match the particular phoneme sequence "$V_e$", "$V_u$", "$V_o$" in the target phoneme train "$V_e$", "$V_u$", "$V_o$" having been acquired in the target phoneme train storing buffer at the current time point.

More specifically, at step S111 above, the CPU 20 determines, focusing on a transition from the last phoneme "$V_u$" in each of the transitive phoneme sequences $Q_{12}$ to $Q_{52}$ identified (set as candidates) at time point $T_2$ when the user designated the target phoneme last, as to which position in the reference phoneme train the currently-designated phoneme "$V_o$" is at, for each of the transitive phoneme sequences. Then, the CPU 20 identifies a new transitive phoneme sequence by placing a reference phoneme located at the determined position at the end of the last-identified transitive phoneme sequence (i.e., concatenatively storing the reference phoneme located at the determined position).

Transitive phoneme sequences identified at time point $T_3$ as above, i.e. transitive phoneme sequences matching the target phoneme train "$V_e$", "$V_u$", "$V_o$" include five transitive phoneme sequences: a sequence comprising positions $P_2$, $P_3$ and $P_4$; a sequence comprising positions $P_9$, $P_{10}$ and $P_{11}$; a sequence comprising positions $P_{15}$, $P_{16}$ and $P_4$; a sequence comprising positions $P_2$, $P_6$ and $P_{11}$; and a sequence comprising positions $P_2$, $P_{13}$ and $P_{14}$. Further, in FIG. 3, the above-mentioned five transitive phoneme sequences identified and stored in response to acquisition of the target phoneme at time point $T_3$ are indicated by $Q_{13}$, $Q_{23}$, $Q_{33}$, $Q_{43}$ and $Q_{53}$, respectively. Further, similarly to the aforementioned, example evaluation values assigned to the transitive phoneme sequences $Q_{13}$, $Q_{23}$, $Q_{33}$, $Q_{43}$ and $Q_{53}$ are indicated by rectangular graphic indicators immediately beneath the respective transitive phoneme sequences $Q_{13}$ to $Q_{53}$.

In the process of step S112 for determining an evaluation value of each of the transitive phoneme sequences, it suffices to determine, at the current time point ($T_3$), a transition probability (transition evaluation value) in accordance with a transition pattern between the currently-acquired (i.e., third) phoneme and the immediately preceding (i.e., second) phoneme, because the transition probability (transition evaluation value) corresponding to the previous transition pattern (between the first and second phonemes) has already been obtained.

For example, beneath the transitive phoneme sequence $Q_{13}$ in FIG. 3 are graphically depicted a transition probability (transition evaluation value) $0_{23}$ assigned to adjoining two phonemes (transition from position $P_2$ to position $P_3$) in the transitive phoneme sequence $Q_{12}$ identified at the last time point $T_2$, and a transition probability (transition evaluation value) $0_{34}$ assigned to adjoining two phonemes (transition from the last identified position $P_3$ to the currently-identified position $P_4$) in the transitive phoneme sequence $Q_{13}$ identified at the current time point $T_3$. Further beneath such transition probabilities in FIG. 3 is graphically depicted a combined probability $W_{13}$ (i.e., overall evaluation value obtained by synthesizing the transition evaluation values) that is a product between the transition probability $O_{23}$ and the transition probability $0_{34}$ ($W_{13}=O_{23}\times O_{34}$). In this case, the transition probability $0_{23}$ assigned to the last transition is about 50% (probability of "½") as noted above and the current transition probability $0_{23}$ assigned to the current transition (transition from position $P_3$ to position $P_4$) corresponds to the above-mentioned A-type transition pattern, and thus, the transition probability $0_{34}$ assigned to the current transition is also about 50% (probability of "½"). Therefore, the combined probability $W_{13}$ between the transition probability $0_{23}$ and the transition probability $0_{34}$ is about 25% (probability of "¼").

Further, beneath each of the other transitive phoneme sequences $Q_{23}$ to $Q_{53}$ identified at time point $T_3$ in FIG. 3 are also graphically depicted a transition probability (transition evaluation value) and combined probability $W_{23}$-$W_{53}$ (i.e., overall evaluation value) corresponding to a transition pattern between every adjoining two phonemes in a similar format to the aforementioned. Note that a sequence of positions $P_2$, $P_3$ and $P_{11}$ as well as the transitive phoneme sequence $Q_{13}$ can exist as a transitive phoneme sequences derived from the transitive phoneme sequence $Q_{12}$ identified at time point $T_2$. However, because only a low transition probability is assigned to a transition from $P_3$ to $P_{11}$, the combined probability of the transition from $P_3$ to $P_{11}$ too would be low. Because it is meaningless to store all probable transitive phoneme sequences, such a transitive phoneme sequence of a low combined probability may be deleted as appropriate without being stored. Thus, one or more transitive phoneme sequences to be identified at step S111 need not be all probable transitive phoneme sequences; only some transitive phoneme sequences having a high probability may be identified as candidates.

As the transitive phoneme sequence increases in length, estimation accuracy with which a user-designated target character is estimated from the reference character train can be enhanced dramatically. Whereas the transitive phoneme sequences $Q_{12}$ to $Q_{32}$ identified at time point $T_2$ are identical to one another in combined probability in the illustrated example of FIG. 3, a notable difference would occur in the combined probability due to an increase in the number of phonemes constituting the target phoneme train once the transitive phoneme sequences $Q_{12}$ to $Q_{32}$ is updated to the transitive phoneme sequences $Q_{13}$ to $Q_{33}$ at time point $T_3$. Namely, character transitions in the reference character train corresponding to a transition from the particular phoneme "$V_u$" to the particular phoneme "$V_o$" in the transitive phoneme sequences $Q_{13}$ and $Q_{23}$ are transitions from $P_3$ to $P_4$ and from $P_{10}$ to $P_{11}$ that correspond to the above-mentioned A-type transition pattern.

Further, a character transition in the reference character train corresponding to a transition from the particular phoneme "$V_u$" to the particular phoneme "$V_o$" in the transitive phoneme sequence $Q_{33}$ is a transition from $P_{16}$ to $P_4$ that corresponds to the above-mentioned transition pattern E. Thus, the transitive phoneme sequences $Q_{13}$ and $Q_{23}$ and the transitive phoneme sequence $Q_{33}$ differ from each other in the transition probability of the transition pattern from the particular phoneme "$V_u$" to the particular phoneme "$V_o$" and hence in the combined probability. Such differences would become more notable as the transitive phoneme sequence increases in length.

Further, the CPU 20 is constructed to, upon acquisition of the combined probabilities of the individual transitive phoneme sequences, compare each of the combined probabilities and a predetermined threshold value through the processing of the target character train estimation section 20*c*. The CPU 20 discards each transitive phoneme sequence whose combined probability is equal to or smaller than the predetermined threshold value (removes the transitive phoneme sequence from the RAM 40). As a consequence, the discarded transitive phoneme sequence is removed from the candidates that are to be used for estimating the user-designated target character train from the reference character train. In the illustrated example of FIG. 3, where the predetermined threshold value is indicated by "Th", the transitive phoneme sequences $Q_{33}$, $Q_{43}$ and $Q_{53}$ are discarded because their combined probabilities $W_{33}$, $W_{43}$ and $W_{53}$ are equal to or smaller than the predetermined threshold Th.

Thus, once the target phonemes are updated to "$V_e$", "$V_u$", "$V_o$", "$V_a$" in response to the user designating the fourth target phoneme "$V_a$" at time point $T_4$ as shown in FIG. 3, the already-discarded transitive phoneme sequences $Q_{33}$, $Q_{43}$ and $Q_{53}$ are excluded from the candidates. The undiscarded transitive phoneme sequences $Q_{13}$ and $Q_{23}$ are maintained or left as the candidates, so that the process for identifying one or more transitive phoneme sequences in the reference phoneme train is performed at step S111 on the basis of the left transitive phoneme sequences $Q_{13}$ and $Q_{23}$. In FIG. 3, it is illustratively shown that a transitive phoneme sequence $Q_{14}$ (i.e., a sequence comprising $P_2$, $P_3$, $P_4$ and $P_5$) and transitive phoneme sequence $Q_{24}$ (i.e., a sequence comprising $P_2$, $P_3$, $P_4$ and $P_8$) where the currently-designated particular phoneme "$V_a$" follows the transitive phoneme sequence $Q_{13}$ and a transitive phoneme sequence $Q_{34}$ (i.e., a sequence comprising $P_9$, $P_{10}$, $P_{11}$ and $P_1$) and transitive phoneme sequence $Q_{44}$ (i.e., a sequence comprising $P_9$, $P_{10}$, $P_{11}$ and $P_5$) where the currently-designated particular phoneme "$V_a$" follows the transitive phoneme sequence $Q_{23}$ are identified.

Because, through the process of step S112 for determining transition evaluation values for the individual transitive phoneme sequences, transition probabilities (transition evaluation values) have already been determined and stored in correspondence with the previous patterns of transitions (between the first and second phonemes and between the second and third phonemes), a transition probability (transition evaluation value) is determined at the current the time point (time point $T_4$) in correspondence with a transition pattern between the currently-acquired (i.e., fourth) phoneme and the immediately-preceding (i.e., third) phoneme.

For example, beneath the transitive phoneme sequence $Q_{14}$ in FIG. 3 are graphically depicted transition probabilities (transition evaluation values) assigned to every adjoining two phonemes identified at the last time point but one $T_2$ and the last time point $T_3$ (i.e., transition from position $P_2$ to position $P_3$ and transition from position $P_3$ to position $P_4$), and a transition probability (transition evaluation value) assigned to latest adjoining two phonemes identified at the current time point $T_4$ (i.e., transition from the last identified position $P_4$ to the current identified position $P_5$). Further beneath such transition probabilities is graphically depicted a combined probability $W_{14}$ that is a product among the three transition probabilities (transition evaluation values). In this case, the transition probabilities assigned to the last transition but one and the last transition are each about 50% (probability of "½") as noted above, and the current transition (from position $P_4$ to position $P_5$) corresponds to the above-mentioned A-type transition pattern. Thus, the transition probability assigned to the current transition is also about 50% (probability of "½"). Thus, the combined probability $W_{14}$ among the three transition probabilities is about 12.5% (i.e., probability of "⅛").

Further, beneath each of the other transitive phoneme sequences $Q_{24}$ to $Q_{44}$ identified at time point $T_4$ are also graphically depicted a transition probability (transition evaluation value) and combined probability $W_{24}$-$W_{44}$ (i.e., overall evaluation value) corresponding to a transition pattern between every adjoining two phonemes, in a similar format to the aforementioned.

Once the combined probability is acquired per transitive phoneme sequence at each of time points $T_2$, $T_3$ and $T_4$, the CPU 20 identifies one character sequence in the reference character train that corresponds to the transitive phoneme sequence whose combined probability is the highest of the transitive phoneme sequences. The thus-identified one character sequence can be estimated to be the user-intended target character train. Note that, because positions of individual phonemes constituting the reference phoneme train and positions of individual characters constituting the reference character train correspond to each other in a one-to-one relationship, it is possible to readily identify the respective positions of the characters in the reference character train that correspond to the respective positions of the particular phonemes constituting the transitive phoneme sequence generated from the reference phoneme train.

More specifically, in the illustrated example of FIG. 3, the transitive phoneme sequence whose combined probability is the highest at time point $T_2$ is $Q_{12}$, $Q_{22}$ and $Q_{32}$, and thus, the CPU 20 selects any one of such transitive phoneme sequences in accordance with an appropriate selection criterion and identifies, on the basis of the selected one transitive phoneme sequence, a character sequence corresponding to the designated target phoneme train "$V_e$, $V_u$". The above-mentioned selection criterion may be any desired criterion; for example, one of the transitive phoneme sequences that has the smallest position data value may be selected, or one of the transitive phoneme sequences may be selected randomly. Assuming that one of the transitive phoneme sequences that has the smallest position data value is selected in the illustrated example of FIG. 3, the transitive phoneme sequence $Q_{12}$ comprising position data $P_2$ and $P_3$ is selected, and "$C_2V_e$, $C_3V_u$" is identified as a character sequence corresponding to the designated target phoneme train "$V_e$, $V_u$". As will be described later, the identified character train may be displayed in real time, and/or a voice based on the identified character train may be audibly generated or sounded in real time. In the case where the identified character train is displayed in real time, information indicative of the identified character train may be stored in the RAM 40 so that a voice corresponding to the one or more characters can be audibly generated and output necessary at appropriate voice generation timing the basis of the stored information.

Further, the transitive phoneme sequence whose combined probability is the highest at time point $T_3$ is $Q_{13}$ and $Q_{23}$, and thus, the CPU 20 selects any one of such transitive phoneme sequences in accordance with the above-mentioned selection criterion and identifies, on the basis of the selected one transitive phoneme sequence, a character sequence corresponding to the designated target phoneme train "$V_e$, $V_u$, $V_o$". For example, the transitive phoneme sequence $Q_{13}$ comprising position data $P_2$, $P_3$ and $P_4$ is selected, and "$C_2V_e$, $C_3V_u$, $C_4V_o$" is identified as a character sequence corresponding to the designated target phoneme train "$V_e$, $V_u$, $V_o$".

Likewise, the transitive phoneme sequence whose combined probability is the highest at time point $T_4$ is $Q_{14}$, and thus, the CPU 20 identifies, on the basis of the transitive phoneme sequence $Q_{14}$, a character sequence corresponding to the designated target phoneme train "$V_e$, $V_u$, $V_o$, $V_a$". In this manner, a character sequence "$C_2V_e$, $C_3V_u$, $C_4V_o$, $C_5V_a$" is identified on the basis of the transitive phoneme sequence $Q_{14}$ comprising position data $P_2$, $P_3$, $P_4$ and $P_5$.

Note that the adjoining two phonemes in each of the transitive phoneme sequences identified through the above-described process of step S111 need not necessarily constitute a transition in the forward direction of the reference character train. For example, the transitive phoneme sequence $Q_{33}$ identified at time point $T_3$ in FIG. 3 presents a transition in the reverse direction from position $P_{16}$ to position $P_4$. Further, as illustratively explained as the F-type transition pattern (transition to a character not present in the reference character train), a sequence including a transition of a character to a position that is not any one of positions $P_1$ to $P_{18}$, shown in FIG. 2A etc., too can be a transitive phoneme sequence in the instant embodiment. Namely, because the user might sometimes erroneously operate or designate the particular phoneme "$V_u$" while intending designation of the particular phoneme "$V_a$" different from the particular phoneme "$V_u$", such a transition too can be identified as a transitive phoneme sequence. Note that, whereas the above-described embodiment has been described as discarding each candidate whose combined probability (overall evaluation value) is equal to or smaller than the predetermined threshold value, the present invention is not so limited and may be constructed in any other desired manner; for example, the present invention may be constructed to store or retain a predetermined number of transitive phoneme sequences of higher combined probabilities than others.

(7) Voice Generation Processing

Figure 4B:
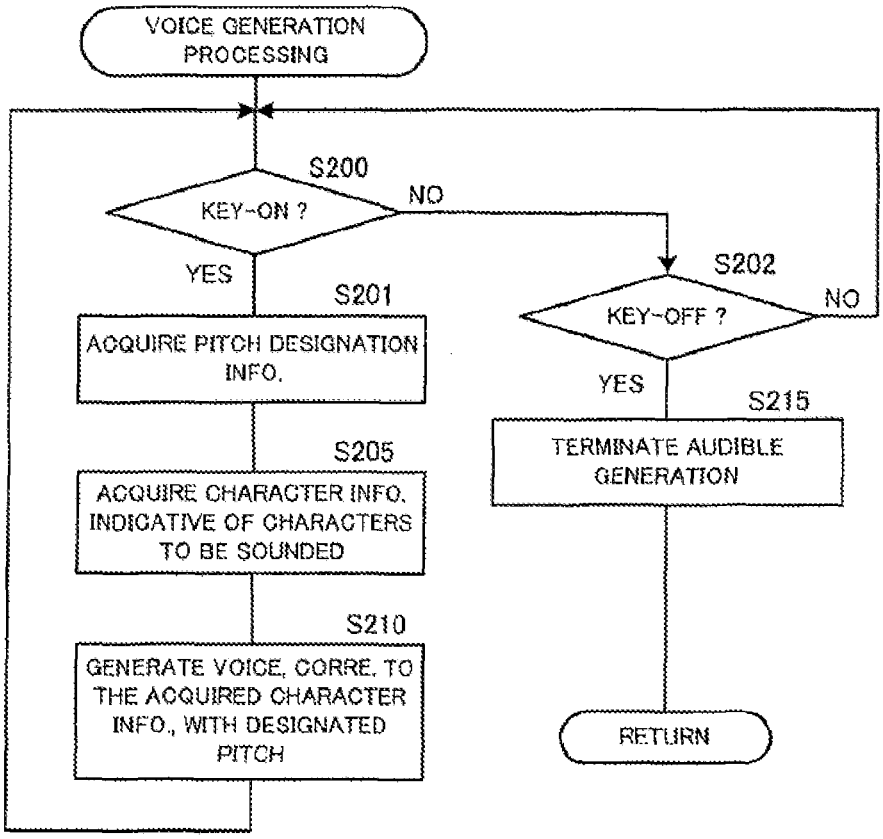
FIG. 4B is a flow chart showing an example of voice generation processing performed by the processor.

In parallel with the target character train estimation processing shown in FIG. 4A, the CPU 20 performs voice generation processing shown in FIG. 4B through the processing by the voice generation program 30*a*. Information indicative of the latest updated character sequence (i.e., information of an estimated target character) obtained as the result of the estimation processing of FIG. 4A responsive to sequential acquisition of target phonemes (at time points $T_1$ to $T_4$) is stored into the RAM 40, so that a voice for sounding the character train is generated at appropriate voice generation timing. As an example, the voice generation timing is set in synchronism with a user's operation for designating a desired pitch via the pitch selector 50. Alternatively, the voice generation timing may be set automatically in accordance with an automatic performance sequence based on MIDI data etc. As another alternative, the voice generation timing may be set on the basis of information received from a remote location via a communication network. In the following description, it is assumed that the voice generation timing is set in synchronism with a user's operation for designating a desired pitch via the pitch selector 50. In principle, it is desirable that timing at which to designate a desired target phoneme via the pitch selector 50 appropriately precede timing at which to generate a voice corresponding to the target phoneme. However, a time delay that would occur in the target phoneme designation timing can be properly absorbed by performing a process for waiting a voice generation start to thereby absorb a time delay of the target phoneme designation timing.

The pitch selector 50 for designating timing at which to generate a voice corresponding to a designated target character train and a pitch of the voice is not the whole of the pitch selector (keyboard) 50, but it is only a part of the pitch selector (keyboard) 50 from which the particular phoneme selector 51 is excluded. Once the user depresses a key on the pitch selector 50 for designating a desired pitch, the CPU 20 determines that the user's operation is a key-on operation at step S200 of FIG. 4B and then proceeds to step S201 where, on the basis of output information of sensors provided in the pitch selector 50, the CPU 20 acquires states of the user's operation (such as pitch designation information indicative of the designated pitch and information indicative of velocity or intensity of the user's operation). Then, the CPU 20 acquires, from the identified character sequence (i.e., character train estimated as the target character train and stored in the RAM 40), character information indicative of one or more characters to be sounded (i.e., one or more characters for which a voice is to be audibly generated) (step S205). For example, the CPU 20 references a pointer indicating up to which character in the character train stored in the RAM 40 has been sounded (or which character in the character train is to be sounded next), on the basis of which the CPU 20 acquires character information indicative of one or more characters yet to be sounded from the character train stored in the RAM 40. If there is no character yet to be sounded, the CPU 20 may acquire character information in accordance with a suitable criterion. For example, the CPU 20 may acquire again character information indicative of one or more characters that were sounded last. Alternatively, if there is no character yet to be sounded, or irrespective of whether there are one or more characters to be sounded, the CPU 20 may wait for a predetermined short time at step S205. In this way, appropriate voice generation can be performed with no problem even when designation of the voice generation timing via the pitch selector 50 has unintentionally slightly preceded designation of the target phoneme due to variation in user's operation time.

Then, the CPU 20 generates a voice corresponding to the acquired character information with a pitch, volume, intensity, etc. designated by the acquired pitch designation information (step S210). More specifically, the CPU 20 acquires, from the voice fragment database 30*c*, voice sound fragment data to be used for reproducing a voice corresponding to the one or more characters indicated by the acquired character information. Further, the CPU 20 performs a pitch conversion process on data corresponding to a vowel included in the acquired voice fragment data so as to convert the data into a vowel sound fragment having the pitch designated by the pitch designation information. Further, the CPU 20 substitutes the vowel sound fragment data, having been subjected to the pitch conversion process, for the data corresponding to the vowel included in the voice fragment data to be used for reproducing the voices corresponding to the one or more characters indicated by the acquired character information, and then performs reverse FFT on data obtained by combining these voice fragment data. As a consequence, a voice signal (digital voice signal in the time domain) for reproducing the voice corresponding to the one or more characters indicated by the acquired character information is generated.

Note that the aforementioned pitch conversion process only needs to be a process for converting a voice of a given pitch into a voice of another pitch and may be performed, for example, by determining a difference between the pitch designated via the pitch selector 50 and a reference pitch of the voice indicated by the voice fragment data and then moving, in a frequency axis direction, a spectral distribution indicated by a waveform of the voice fragment data by a frequency corresponding to the determined difference. Needless to say, the pitch conversion process may be performed in any of various other desired manners and may be performed on the time axis. Further, in the operation of step S210, various factors, such as a pitch, volume and color, of the voice to be generated may be made adjustable; for example, audio control for assigning a vibrato or the like may be performed on the voice to be generated.

Once the voice signal is generated, the CPU 20 outputs the generated voice signal to the above-mentioned sound output section 70. The sound output section 70 converts the voice signal into an analogue waveform signal and amplifies and audibly outputs the analogue waveform signal. Thus, from the sound output section 70 is audibly output a voice that corresponds to the one or more characters indicated by the acquired character information and that has the pitch, volume, etc. designated via the pitch selector 50.

Further, on the basis of output information from the sensors provided in the pitch selector 50, the CPU 20 determines, at step S202, whether any key depression operation on the pitch selector 50 has been terminated, i.e. whether the user has performed a key-off operation. If any key depression operation on the pitch selector 50 has been terminated as determined at step S202, the CPU 20 deadens (or attenuates) the corresponding voice being generated so as to terminate audible generation, from the sound output section 70, of the voice signal (step S215). As a consequence, audible output, from the sound output section 70, of the voice is terminated. With the aforementioned arrangements, the CPU 20 causes the voice of the pitch and intensity designated via the pitch selector 50 to be output continuously for a time period designated via the pitch selector 50.

The above-described processing permits a performance where a user-desired character is output with a user-desired pitch, in response to the user operating the pitch selector 50 immediately after (or simultaneously with) his or her operation on the particular phoneme selector 51. Further, even when the user has operated the particular phoneme selector 51 immediately following his/her pitch designating operation on the pitch selector 50, i.e. even when the user's operation of the particular phoneme selector 51 is slightly later than the pitch designating operation on the pitch selector 50, there can be output a voice which is not substantially different from (i.e., which is substantially the same as) a voice that would be output when the operation of the particular phoneme selector 51 is earlier than the pitch designating operation on the pitch selector 50.

The CPU 20 is also constructed in such a manner, when key depression on the pitch selector 50 has been repeated without the particular phoneme selector 51 being operated, the CPU 20 acquires again character information indicative of one or more characters for which a voice has been generated immediately before the key depression, so that the voice based on the same character information can be generated repeatedly. Such a function is suited for use in a case where a voice corresponding to certain characters like "Ra" is to be output repeatedly a plurality of times with a same pitch or different pitches.

With the above-described embodiment, the user can designate a desired character in a target character train through a simple operation of designating necessary phonemes of the limited plurality of kinds of particular phonemes. Further, even when the user has performed various operations including ad lib and erroneous operations, the CPU 20 can estimate, from a predetermined reference character train, each user-designated character with a high accuracy. Thus, the user can designate characters in the predetermined reference character train with an increased degree of freedom. Further, the user can cause lyrics of a desired reference character train to be output with a user-desired tempo and with user-desired pitches. Therefore, in performing the lyrics of the desired reference character train, the user can freely change the melody.

(8) User Interface

Because a phoneme designated through an operation on the particular phoneme selector 51 indirectly indicates a desired character in the reference character train, various supports may be provided for allowing the user to intuitively designated an intended character. For providing such supports, the instant embodiment is constructed in such a manner that a predetermined user interface is displayed on a display section of the input/output section 60 to allow the user to operate the particular phoneme selector 51 more intuitively.

Figure 1C:
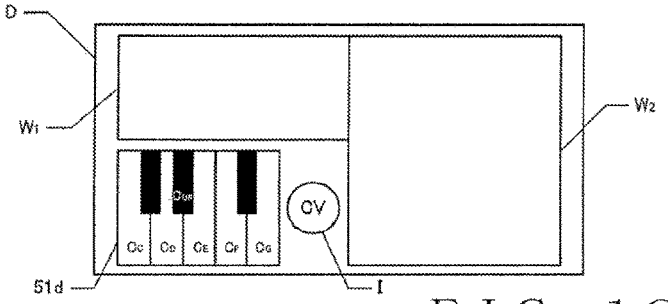
FIG. 1C is a diagram showing an example display on a display section.

FIG. 1C is a view showing an example of the user interface. Through processing of the display control section 20*d*, the CPU 20 displays the user interface on the display section D of the input/output section 60. With the user interface shown in FIG. 1C, an image of the particular phoneme selector 51 (as an example, image portions of a plurality of white keys and a plurality of block keys) is displayed on the display section D of the input/output section 60. When a particular phoneme corresponding to any one of the keys is designated, a character estimated in response to the designation of the particular phoneme is displayed, as the next most likely candidate, within the image portion of the one key. In the instant embodiment, a character estimated in response to designation of a particular phoneme is displayed, as the most likely candidate, within the image portion of a corresponding one of the keys of "C", "D", "E", "F", "G" and "D#" constituting the particular phoneme selector 51. In FIG. 1C, reference characters "$C_C$", "$C_D$", "$C_E$", "$C_F$", "$C_G$" and "$C_{D\#}$" depicted in the image portions of the individual keys show characters of the most likely candidates (i.e., the most likely candidate characters) estimated in response to designation of the corresponding particular phonemes. Thus, in an actual implementation, actual characters are displayed at positions where the reference marks "$C_C$", "$C_D$", "$C_E$", "$C_F$", "$C_C$" and "$C_{D\#}$" are depicted. Once the next most likely candidate character is displayed on the display section in this manner, the user can intuitively confirm the corresponding key of the particular phoneme selector 51 and the next most likely candidate in association with each other by viewing the display section. Thus, even though the instant embodiment is constructed in such a manner that the user designates a limited number of phonemes via the particular phoneme selector 51, it can make the user feel as if he or she were substantially actually designating a character.

Note that, with the user interface shown in FIG. 1C, various other information than the next most likely candidate character is displayed on the display section. For example, the latest one character that has been estimated, through the current estimation processing, as designated by the user is displayed in an icon I. Further, the whole or part of the reference character train selected as an object of processing is displayed on a window $W_1$, and the whole or part of the reference character train having been subjected to grouping as shown in FIG. 2B is displayed on a window $W_2$. Note that, in FIG. 1C, the one character that has been estimated as designated by the user from the reference character train is displayed in the icon I by a reference mark "CV". With such arrangements, the user can check whether his/her intended character and the estimated character match each other, by viewing the display section. Note that a character sequence comprising a plurality of characters having been identified up to the current time point may be displayed in place of the icon I displaying only the latest one character.

A display for highlighting a group including the character that has been estimated as designated by the user from the reference character train may be additionally displayed on the window $W_2$ by use of results of the estimation processing. To provide such an additional display, the CPU 20 only has to determine, after the estimation of the character, a morpheme group including that character and then supply the display section of the input/output section 60 with a control signal for highlighting the morpheme group.

The following describe an example manner in which the next most likely candidate to be displayed in each of the key image portions of the image 51*d* is determined. At time point $T_3$ shown in FIG. 3, the CPU 20 assumes, before the particular phoneme selector 51 is actually operated next, cases where individual ones of the particular phonemes are designated following the current designation of the phoneme "$V_o$", and then estimate the most likely candidates separately for the individual cases. For example, in the case where the phoneme "$V_a$" is assumed to have been designated following the designation of the phoneme "$V_o$", the CPU 20 estimates, on the basis of a transitive phoneme sequence whose combined probability is the highest, that a character at position $P_5$ has been designated, as illustrated in relation to time point $T_4$. For each of the other particular phonemes too, the CPU 20 estimates a designated character in the case where the phoneme is assumed to have been designated following the designation of the phoneme "$V_o$", in a similar manner to the aforementioned.

Upon completion of such character estimation responsive to the assumed designation of each of the phonemes, the CPU 20 sets the character estimated for the phoneme as the next most likely candidate character. Then, through the processing by the display control section 20*d*, the CPU 20 displays the next most likely candidate character on an area of the image 51*d* of the display section D.

(9) Purpose of a Plurality of Transition Patterns

The above-described embodiment is constructed to extract, from the reference phoneme train, one or more transitive phoneme sequences where particular phonemes transit similarly to a user-designated target phoneme train, rather than extracting, from the reference phoneme train, only a phoneme sequence that completely matches the designated target phoneme train, and then estimate a user-designated target character train on the basis of a transition probability of each of the transitive phoneme sequences. Thus, the CPU 20 identifies, as candidates, a plurality of transitive phoneme sequences corresponding to one or more cases including 1) a case where the user has made an ad lib jump from one character position to another in designating a target phoneme train and 2) a case where the user has performed an erroneous operation in designating the target phoneme train, and then, the CPU 20 estimates the user-designated character train from the reference character train on the basis of a particular transitive phoneme sequence selected from among the candidates. Thus, even when the user has performed an erroneous operation or an ad-lib operation comprising designation of a target phoneme train while changing as desired the correct order of characters in the reference character train, the instant embodiment can appropriately estimate the user-designated character from the reference character train.

Further, in the instant embodiment, where a plurality of typical transition patterns are predefined, the estimation processing can be performed for estimating a target character train with all of the typical transition patterns taken into consideration. Patterns that can occur as character transitions in the user-designated target phoneme train can be considered sufficiently by simply analyzing the plurality of typical transition patterns, with the result that the instant embodiment can estimate the user-designated characters with a high accuracy through the simple analysis.

Further, the instant embodiment can enhance the estimation accuracy of a character designated by the user from the reference character train, by representing, as a transition pattern, a characteristic transition of characters that occurs as the user designates the character from the reference character train. In many cases, if lyrics contain a repetition, for example, an arranged order of characters in the repetition and an arranged order of characters in another portion of the lyrics where there is no repetition notably differ from each other. Thus, when the above-mentioned B-type transition pattern has occurred, for example, the instant embodiment can estimate with a high probability that the user has repetitively designated a particular portion of the lyrics, thereby enhancing the estimation accuracy.

Note that, in the case where the reference character train is lyrics having first and second verses, two character trains comprising a same sequence of characters may exist in different portions (e.g., musical periods) of lyrics of the first and second verses. In such a case, the user may sometimes sing, after one of the two character trains (of the first and second verses) comprising the same sequence of characters, a word immediately following the other character train rather than exactly in a predetermined progression order of the lyrics. Namely, in the illustrated example of FIG. 2B, for example, the user may sometimes sing a lyrics word located at position $P_{12}$, rather than a lyrics word located at position $P_5$, following the character train $S_1$. Such a transition is an extremely characteristic transition that may occur in an ad-lib performance, piano performance practice, etc. Because such a transition corresponds to the above-mentioned C-type transition pattern (i.e., transition from a given character train to a character following the same character train located at a different position from the given character train), the instant embodiment can enhance the estimation accuracy by applying the C-type transition pattern to calculate an evaluation value.

Further, the instant embodiment, where some of the above-mentioned transition patterns are patterned on the basis of the aforementioned grouping, can enhance the accuracy with which user-designated characters are estimated based on such transition patterns. In the aforementioned examples, transitions over two or more characters are classified in accordance with two transition patterns, i.e. the transition pattern D and the E-type transition pattern. Further, in a progression of ordinary lyrics, small variations in position of the lyrics (such as erroneous skipping of one character) are more likely to occur than large variations in position of the lyrics. Thus, on the basis of a positional relationship between a transited-from group and a transited-to-group, a determination can be made as to whether or not a transit is likely to occur, and the estimation can be performed with an enhanced accuracy by setting a transition probability of the type-D transition pattern greater than a transition probability of the type-E transition pattern.

The instant embodiment can further enhance the estimation accuracy by using particular grouping to define further detailed transition patterns. For example, in the case of individual morpheme groups, each of which is a meaningful set of characters, a character can transit from a given position to the head of any one of the morpheme groups, but there is an extremely low probability that a character will transit to a halfway position or end position any one of the morpheme groups. Thus, the estimation accuracy can be enhanced by setting a probability of a transition to the head of a group higher than a probability of a transition to a non-head position of a group.

(10) Musical Score Notation of Target Phoneme Train

As noted above, the plurality of keys having the respective particular phonemes allocated thereto is used as the particular phoneme selector 51. With such arrangements, the user can designate desired particular phonemes by performing operations just as in a musical instrument performance. Further, by writing, on a musical score, pitches (key names) corresponding to the particular phoneme selector 51, an operational procedure of the particular phoneme selector 51 for designating a predetermined target character train can be recorded in writing (in a written form). Such information recorded in writing allows an operational procedure for designating a predetermined target character train to be transferred to a third person in an objective way and allows the user to practice repeatedly with reference to the written information.

(11) Other Embodiments

Application of the present invention is not limited to the keyboard musical instrument 10, and the present invention may be applied to any other electronic musical instruments provided with the pitch selector 50, reproduction apparatus for reproducing recorded sound or audio information including the reference character information 30*b* and recorded image information, etc.

Further, the operators for designating the particular phonemes is not limited to the keys of the keyboard musical instrument 10. The present invention may be constructed to permit designation of the particular phonemes by means of a keyboard, touch panel or the like. Various other techniques may be employed for designating particular phonemes. For example, flick operations may be employed in place of, or in addition to, key depression operations and button depression operations. Furthermore, although each one of the particular phonemes may be associated with any one of the keys or buttons, there may be employed, among others, a construction where a larger number of particular phonemes are designated by combinations of operations of a plurality of (e.g., three) keys or buttons.

Furthermore, the present invention may be constructed in such a manner that a target phoneme train once designated by the user can be modified by the user. For example, when the user has performed an erroneous operation in designating a particular phoneme, the CPU 20 may receive from the user an operation for canceling the erroneous operation and thereby cancel the erroneous operation. Also, when a target character train estimated through the estimation processing is erroneous estimation, the CPU 20 may receive from the user an operation for canceling the erroneous estimation and thereby cancel the erroneous estimation. Furthermore, the character estimation described above in relation to the embodiment may be performed only on a portion of the reference character train (e.g., only on characters at an initial stage of a performance immediately following a start of a performance). In such a case, the present invention can be constructed in such a manner that lyrics words at the start of the performance are estimated from the user-designated particular phonemes and the lyrics words automatically progress, character by character, following the start of the performance, and thus, the present invention can facilitate user's operations during the course of the performance while appropriately dealing with an ad-lib performance.

Furthermore, an upper limit may be set on the number of transitions to be referenced in acquiring a transition probability of a transitive phoneme sequence. For example, the upper limit set on the number of transitions may be four to eight, and if the upper limit on the number of transitions is four, a target phoneme train will be formed on the basis of the last-designated particular phoneme and the three particular phonemes designated earlier than the last-designated particular phoneme.

Further, values of transition probabilities allocated to individual transition patterns may be modified as appropriate during execution of the estimation processing. For example, as designation of particular phonemes sequentially progresses during sequential particular phoneme designation to request a given target character train, it may sometimes become clear, on the basis of transitive phoneme trains identified previously before the current time point, that a probability of a given transition pattern occurring afterwards is high or low. In such a case, in the estimation processing responsive to particular phonemes subsequently designated to request the target character train, the transition pattern may be evaluated with the transition probability modified as appropriate. Namely, instead of the transition probability allocated to each of the transition patterns being fixed, the transition probability of any of the patterns occurring after the current time point may be adjusted as appropriate on the basis of a transitive phoneme sequence identified in accordance with a plurality of target phoneme trains designated previously before the current time point.

More specifically, let's assume a case where a same character train is repeated twice as indicated by positions $P_{15}$ and $P_{16}$ in FIG. 2C and a reference phoneme immediately following the repetition is "$V_e$". In this case, if a target phoneme train designated at and after position $P_{16}$ is "$V_e$, $V_u$, $V_e$, $V_u$, $V_e$", then transitive phoneme sequence candidates will be one obtained in response to the user designating target characters with the characters at positions $P_{15}$ and $P_{16}$ repeated three times, and one obtained in response to the user designating target characters with the characters at positions $P_{15}$ and $P_{16}$ repeated twice and then causing the lyrics to progress in accordance with the accurate order of the reference character train. Normally, however, because an accurate transition as represented in the reference character train is most likely to occur (i.e., has the highest probability), it is estimated from the reference character train that the user will designate the former of the transitive phoneme sequences with a higher probability than the latter of the transitive phoneme sequences. Thus, the transition probability may be modified such that the latter transitive phoneme sequence candidate is evaluated higher than the former transitive phoneme sequence candidate.

Further, let's assume a case where, in the case where the same character train is repeated twice as indicated by positions $P_{15}$ and $P_{16}$ in FIG. 2C, a reference phoneme train immediately following the repetition is "$V_e$, $V_u$". In such a case, if a target phoneme train designated at and after position $P_{15}$ is "$V_e$, $V_u$, $V_e$, $V_u$, $V_e$, $V_u$", then transitive phoneme sequence candidates will be one obtained in response to the user designating target characters with the characters at positions $P_{15}$ and $P_{16}$ repeated three times, and one obtained in response to the user designating target characters with the characters at positions $P_{15}$ and $P_{16}$ repeated twice and then causing the lyrics to progress in accordance with the accurate order of the reference character train. In this case, it is not possible to identify (distinguish)

between the former transitive phoneme sequence candidate and the latter transitive phoneme sequence candidate at a stage where the particular phoneme "$V_u$" is designated last, but as the designation of the particular phonemes sequentially progresses, it is possible to identify (distinguish) between the case where the repletion has been made and the case where the lyrics have been caused to progress in accordance with the accurate order of the reference character train. For example, in the case where the same character train is repeated twice as indicated by positions $P_{15}$ and $P_{16}$ in FIG. 2C and where a reference phoneme train immediately following the repetition is "$V_e$, $V_u$, $V_a$", it can be estimated that the latter transitive phoneme sequence is likely to occur with a high probability if the user designates the particular phoneme "$V_a$" after repeating three times designation of the particular phonemes "$V_e$, $V_u$", and that the former transitive phoneme sequence is likely to occur with a high probability if the user designates the particular phoneme "$V_e$". Thus, the transition probability may be modified such that the transitive phoneme sequence of a higher probability is evaluated relatively high.

Further, in the above-described embodiment, the particular phoneme other than vowels is the only consonant "n", and only the key for designating the consonant "n" corresponding to the particular phoneme is a black key, Thus, when the consonant "n" corresponding to the particular phoneme has been designated, the estimation can be regarded as being more reliable than when any of the other particular phonemes has been designated, and the transition probability may be modified such that each transitive phoneme sequence whose last particular phoneme is the consonant "n" is evaluated relatively high.

This application is based on, and claims priority to, JP PA 2014-153596 filed on 29 Jul. 2014. The disclosure of the priority application, in its entirety, including the drawings, claims, and the specification thereof, are incorporated herein by reference.

What is claimed is:

1. An apparatus for estimating a target character train from a predefined reference character train, said apparatus comprising:

a manually operable selector configured to select only from among a limited plurality of kinds of particular phonemes in response to a manual operation of the manually operable selector by a user; and a processor configured to:

acquire a reference phoneme train related to the predefined reference character train, the reference phoneme train being indirectly representative of the reference character train via the limited plurality of kinds of particular phonemes;

acquire, a target phoneme train designated by a user, a phoneme train time-serially input from said manually operable selector in response to manual operations of the manually operable selector by a user, the target phoneme train being indirectly representative of the target character train via the particular phonemes in the target phoneme train;

identify, based on a comparison between the designated target phoneme train and the reference phoneme train, a character sequence in the reference character train that corresponds to a sequence of the particular phonemes in the reference phoneme train matching the designated target phoneme train, wherein the identified character sequence is estimated to be the target character train; and display the identified character sequence on a display or generate a voice based on the identified character sequence to be audibly output from a speaker as an analog waveform signal, the identified character sequence corresponding to phonemes from among more kinds of phonemes than the limited plurality of kinds of particular phonemes only from among which the manually operable selector is configured to select.

2. The apparatus as claimed in claim 1, wherein the limited plurality of kinds of particular phonemes includes vowels.

3. The apparatus as claimed in claim 1, wherein the limited plurality of kinds of particular phonemes includes a particular consonant.

4. The apparatus as claimed in claim 1, wherein said processor is further configured to, each time one or more phonemes are input in response to user operations, display, on a display, at least one character having been identified up to a current time point and a next character in the reference character train, estimated from the identified character sequence, as a candidate.

5. The apparatus as claimed in claim 1, wherein, in order to identify the character sequence in the reference character train that corresponds to the sequence of the particular phonemes in the reference phoneme train matching the target phoneme train, said processor is configured to:

identify one or more transitive phoneme sequences in the reference phoneme train that correspond to the sequence of the particular phonemes in the target phoneme train, the transitive phoneme sequences including at least one of a sequence comprising an accurate arrangement of the particular phonemes in the reference phoneme train and one or more sequences comprising a slightly disordered arrangement of the particular phonemes in the reference phoneme train;

assign an evaluation value to each of the identified transitive phoneme sequences in accordance with a degree of accuracy of arrangement of the particular phonemes in the transitive phoneme sequence; and identify a character sequence in the reference character train that corresponds to any one of the transitive phoneme sequences that has been assigned a relatively high evaluation value.

6. The apparatus as claimed in claim 5, wherein, in order to assign an evaluation value to each of the identified transitive phoneme sequences in accordance with the degree of accuracy of arrangement of the particular phonemes in the transitive phoneme sequence, said processor is configured to assign a respective evaluation value to every adjoining two phonemes in the transitive phoneme sequence in accordance with a transition pattern thereof and generate an overall evaluation value for the transitive phoneme sequence by combining the evaluation values assigned.

7. The apparatus as claimed in claim 1, wherein said processor is further configured to acquire pitch designation information designating a pitch of the voice to be generated and generate the voice based on the identified character sequence with the pitch designated by the acquired pitch designation information.

8. The apparatus as claimed in claim 1, wherein the processor is further configured to:

divide the reference character train into groups each comprising a plurality of characters, the reference phoneme train having groups corresponding to the groups of the divided reference character train; and wherein the comparison between the designated target phoneme train and the reference phoneme train comprises a comparison between the designated target phoneme train and the groups of the divided reference phoneme train.

9. The apparatus as claimed in claim 8, wherein the processor is configured to divide the reference character train into the groups at least on a morpheme-by-morpheme basis.

10. The apparatus as claimed in claim 1, wherein the apparatus is a musical instrument.

11. A method for estimating a target character train from a predefined reference character train, said method comprising:

acquiring, by a processor, a reference phoneme train related to the predefined reference character train, the reference phoneme train being indirectly representative of the reference character train via a limited plurality of kinds of particular phonemes;

receiving, by the processor, an output from a manually operable selector that is configured to select only from among the limited plurality of kinds of particular phonemes in response to a manual operation of the manually operable selector by a user;

acquiring, by the processor, as a target phoneme train designated by a user, a series of the particular phonemes based on the received output from the manually operable selector in response to manual operations of the manually operable selector by a user, the target phoneme train being indirectly representative of the target character train via the particular phonemes in the target phoneme train;

identifying, by the processor and based on a comparison between the acquired target phoneme train and the reference phoneme train, a character sequence in the reference character train that corresponds to a sequence of the particular phonemes in the reference phoneme train matching the acquired target phoneme train, wherein the identified character sequence is estimated to be the target character train; and displaying the identified character sequence on a display or generating a voice based on the identified character sequence to be audibly output from a speaker as an analog waveform signal, the identified character sequence corresponding to phonemes from among more kinds of phonemes than the limited plurality of kinds of particular phonemes only from among which the manually operable selector is configured to select.

12. A non-transitory computer-readable storage medium containing a group of instructions executable by a processor to implement a method for estimating a target character train from a predefined reference character train, said method comprising:

acquiring a reference phoneme train related to the predefined reference character train, the reference phoneme train being indirectly representative of the reference character train via a limited plurality of kinds of particular phonemes;

receiving an output from a manually operable selector that is configured to select only from among the limited plurality of kinds of particular phonemes in response to a manual operation of the manually operable selector by a user;

acquiring, as a target phoneme train designated by a user, a series of the particular phonemes based on the received output from the manually operable selector in response to manual operations of the manually operable selector by a user, the target phoneme train being indirectly representative of the target character train via the particular phonemes in the target phoneme train;

identifying, based on a comparison between the acquired target phoneme train and the reference phoneme train, a character sequence in the reference character train that corresponds to a sequence of the particular phonemes in the reference phoneme train matching the acquired target phoneme train, wherein the identified character sequence is estimated to be the target character train; and displaying the identified character sequence on a display or generating a voice based on the identified character sequence to be audibly output from a speaker as an analog waveform signal, the identified character sequence corresponding to phonemes from among more kinds of phonemes than the limited plurality of kinds of particular phonemes only from among which the manually operable selector is configured to select.

* * * * *